US005979126A

United States Patent [19]

Kurino et al.

[11] Patent Number: 5,979,126

[45] Date of Patent: Nov. 9, 1999

[54] SEISMIC RESPONSE CONTROL METHOD FOR STRUCTURE

[75] Inventors: Haruhiko Kurino; Naoki Niwa, both of Tokyo, Japan

[73] Assignee: Kajima Corporation, Tokyo, Japan

[21] Appl. No.: 08/867,075

[22] Filed: Jun. 2, 1997

[30] Foreign Application Priority Data

| | | | |
|---|---|---|---|
| Jun. 5, 1996 | [JP] | Japan | 8-142914 |
| Dec. 10, 1996 | [JP] | Japan | 8-329709 |
| Dec. 17, 1996 | [JP] | Japan | 8-336668 |
| Dec. 27, 1996 | [JP] | Japan | 8-350234 |

[51] Int. Cl.[6] ..... E04B 1/98; E04H 9/20

[52] U.S. Cl. ..... 52/167.2; 52/167.1; 52/167.3

[58] Field of Search ..... 52/167.1, 167.3, 52/167.4

[56] References Cited

U.S. PATENT DOCUMENTS 4,910,929 3/1990 Scholl ..... 52/176 R 5,491,938 2/1996 Niwa et al. ..... 52/167.1

*Primary Examiner*—Christopher T. Kent
*Assistant Examiner*—Yvonne Horton-Richardson
*Attorney, Agent, or Firm*—Muramatsu & Associates

[57] ABSTRACT

There is disclosed a seismic response control method for a structure, comprising the steps of installing a seismic response control device in a structural component of stiffness $K_j$; and controlling a characteristic of story restitutive force based of story restitutive force Q ($=Q_s+F$) given as the sum of restitutive force $Q_s$ of the structural component installed with the seismic response control device and force F generated from the seismic response control device so as to maintain or vary the characteristic of story restitutive force, which is shown on a coordinate plane as the relation between amplitude D(t) and story restitutive force Q(t) of the structural component portion, in the specific form, in response to the kaleidoscopic state of vibration. The seismic response control device is controlled efficiently with a sensor for measuring a state value of a device part and a simple configuration on microprocessor level.

24 Claims, 23 Drawing Sheets

α=0

α=0.5

α=1

α=1.5

α=2.0

$\alpha = 0$ $\alpha = 0.5$ $\alpha = 1$ $\alpha = 1.5$ $\alpha = 2.0$

SEISMIC RESPONSE CONTROL METHOD FOR STRUCTURE

BACKGROUND OF THE INVENTION

1. Field of the Invention

This invention relates to a seismic response control method, in which a seismic response control device comprised of a variable damping device or an actuator is installed in a structure, and seismic response control of the structure is performed by controlling a characteristic of restitutive force, that is, hysteresis in a structural body installed with the seismic response control device.

2. Description of the Prior Art

In a prior art, a passive seismic response control device covers a dynamic vibration absorber which reduces vibration of a structure in response to reaction force of a weight mounted on the top or inside of the structure by synchronizing the weight supported by a spring and a damper with a natural period of the structure (See Japanese Patent Publications B2-H3-38386 and B2-H5-55741, for instance).

Further, a passive seismic response control device adopting a damping device covers a device which attains a reduction in vibration of a building by setting a damping coefficient of a damping device, which is disposed in a frame composed of columns and beams of a structure so as to be connected to an earthquake-resisting component, at a certain value or automatically varying the damping coefficient according to the state of vibration (See Japanese Patent Publications B2-2513356 and B2-2528589, for instance).

On the other hand, the present inventors have developed a variety of active seismic response control systems such as a seismic response control method, in which an earthquake-resisting component is installed in a frame composed of columns and beams of a structure through a variable stiffness device or a variable damping device, and the evaluation of damping capacity of the structure is made by varying a stiffness of the frame composed of columns and beams with the variable stiffness device, or varying a damping coefficient of the variable damping device, and a seismic response control method, in which damping force generated from a variable damping device is applied as control force (See Japanese Patent Publications B2-H7-42811 and B2-H7-45781, for instance).

In a passive seismic response control method, a damping device 11 is installed in each story of a building as shown in FIG. 18, for instance, and as a result, this method particularly offers the advantages of dispensing with the installation of a sensor and the supply of external energy, whereas it has the disadvantages of needing to set a damping coefficient relatively to a specific vibration mode or being highly restricted in vibration damping effects by a stiffness of a mounting brace or the like installed with the damping device.

On the other hand, according to an active seismic response control method adopting a variable damping device, a sensor 22 is disposed on portions of a building as shown in FIG. 19, for instance, a seismic or like response of the building is synthetically judged by a computer 23, and a command is issued to a variable damping device 21 disposed in each story of the building to provide high damping capacity to the building.

However, even in this case, it is necessary to perform complicated analysis by the computer on the basis of information from the sensor in each story. Further, detailed advance examinations are required for adjustment.

An object of the present invention is to solve the above problems, and, in a seismic response control method for a structure adopting a seismic response control device such as a variable damping device and an actuator, to enable efficient seismic response control by controlling force generated from the device so as to maintain a hysteresis characteristic on a story basis, or vary the hysteresis characteristic under specific conditions.

SUMMARY OF THE INVENTION

A seismic response control method for a structure according to the present invention comprises the steps of installing a seismic response control device in a structural component (a frame composed of columns and beams or a base isolation story) of stiffness $K_f$ in a structure; and controlling the seismic response control device in reference to a characteristic of story restitutive force based on story restitutive force Q ($=Q_s+F$) given as the sum of restitutive force $Q_s$ of only the frame composed of columns and beams in a story installed with the seismic response control device and force F generated from the seismic response control device, so as to maintain or vary the form of the characteristic of story restitutive force shown on a coordinate plane as the relation between story amplitude D(t) and story restitutive force Q(t), in response to the kaleidoscopic state of vibration.

A seismic response control method in case of using, for instance, a variable damping device as a seismic response control device comprises the steps of installing a variable damping device in a structural component (a frame composed of columns and beams or a base isolation story) of stiffness $K_f$ in a structure; setting a specified characteristic of restitutive force on a coordinate plane such as to optimize, for instance, energy absorption property or the like in the relation between amplitude D and restitutive force Q within a range controllable by the variable damping device on the basis of frequency transfer characteristics of a target structural component; and controlling damping force F generated from the variable damping device so as to maintain or vary the form of the specified characteristic of restitutive force, in response to the kaleidoscopic state of vibration. In view of structural restrictions, the characteristic of restitutive force in this case is determined on the basis of story restitutive force Q ($=Q_s+F$) given as the sum of restitutive force $Q_s$ of only a structural component portion such as a frame composed of columns and beams in a story or a base isolation story installed with the variable damping device and damping force F generated from the variable damping device such as to permit a variation of stiffness from 0 to K.

A seismic response control method according to one mode of the present invention comprises the steps of installing an earthquake-resisting component in a frame of stiffness $K_f$ composed of columns and beams through a variable damping device; in reference to a characteristic of story restitutive force based on story restitutive force Q ($=Q_s+F$) given as the sum of restitutive force $Q_s$ of only the frame composed of columns and beams in a story installed with the variable damping device and damping force F generated from the variable damping force such as to permit a variation of stiffness from 0 to K in relation to the earthquake-resisting component, selecting a specified characteristic of story restitutive force which represents the relation between story amplitude D(t) and story restitutive force Q(t) such as to optimize energy absorption property or response reduction effects, in response to the kaleidoscopic state of vibration on the basis of frequency transfer characteristics of a target story in response to an earthquake or wind; and controlling the damping force F generated from the variable damping device so as to maintain the characteristic of restitutive force, which is shown on a coordinate plane, in the form of a quasi-similar figure, in response to a kaleidoscopic change of the state of vibration. In this case, efficient seismic response control which is hardly affected by the state of vibration such as a vibration level and a vibration period is enabled with more simplified installation and device than those in the active seismic response control method of the prior art.

According to a specific mode of the present invention, it may be considered that a seismic response control method further comprises the steps of finding a form parameter $\alpha=Q_0/(K_f \cdot D)$, which is concerned with a characteristic of restitutive force representing the relation between story amplitude D and story restitutive force Q in a certain vibration state and provides, on a coordinate plane, a characteristic of story restitutive force such as to maximize energy absorption property in reference to a plurality of arbitrary story restitutive forces $Q_0$, in response to the kaleidoscopic state of vibration on the basis of frequency transfer characteristics of a target story in response to an earthquake or wind, under the structural restrictions; selecting a specific form parameter $\alpha$ such as to optimize energy absorption property or response reduction effects, among a plurality of form parameters a thus found; and controlling damping force F generated from a variable damping device so as to maintain the selected form parameter $\alpha$ substantially constant, in response to a kaleidoscopic change of the state of vibration.

According to a further specific mode of the present invention, it may be considered that a seismic response control method further comprises the steps of finding a deformation $X_B$ of an earthquake-resisting component portion on the basis of generated damping force F measured at a device part of a variable damping device; finding a story deformation x and a story velocity dx/dt of a target story on the basis of both the deformation $X_B$ of the earthquake-resisting component portion and a device part deformation $X_D$ measured by a sensor; and finding a control command value u(t) corresponding to the characteristic of story restitutive force on the basis of both the story deformation x and the story velocity dx/dt.

As the result of setting and controlling the form parameters concerned with the characteristic of story restitutive force, a control rule may be simplified, regardless of the state of vibration. Further, since the variable damping device may be controlled by a sensor or the like installed only in a device part of the variable damping device, and also controlled on a target story basis, independently of the other story, control is enabled even with a configuration on microprocessor level. FIG. 1A schematically shows the fact that a variable damping device 1 interposed between a frame 4 composed of columns and beams and a V-shaped brace 5 is controlled independently on a story basis, and only a simple energy supply is sufficient for control of the variable damping device, in contract with the prior art shown in FIGS. 18 and 19.

One of practical control rules applied to the above seismic response control method is as follows. That is, it may be considered that the control rule is to find an envelope waveform D(t) of a kaleidoscopic story deformation x, and to find a control command value u(t) with a control circuit which provides $$u(t)=-K_f\{x(t)-\alpha \cdot sgn(dx(t)/dt) \cdot D(t)\}$$

as a kaleidoscopic control command value.

In this expression, sgn(dx(t)/dt) is +1 when $(dx(t)/dt) \geqq 0$, while being −1 when $(dx(t)/dt)<0$. That is, $u(t)=-K_f\{x(t)-\alpha \cdot D(t)\}$ when $(dx(t)/dt) \geqq 0$. On the other hand, $u(t)=-K_f\{x(t)+\alpha \cdot D(t)\}$ when $(dx(t)/dt)<0$.

Incidentally, various methods inclusive of a method which will be described later may be applied to a way of finding the envelope waveform D(t) of the story deformation x. Also, variable methods may be applied to a way of finding the control command value u(t), although it varies according to a way of setting a characteristic of story restitutive force, as a matter of course.

According to another mode of the present invention, a natural period of a structure is varied by controlling a characteristic of story restitutive force so as to enable seismic response control based on unresonance with seismic vibration. That is, a seismic response control method according to another mode of the present invention comprises the steps of installing an earthquake-resisting component in a frame of stiffness $K_f$ composed of columns and beams through a variable damping device; in reference to a characteristic of story restitutive force based on story restitutive force Q $(=Q_s+F)$ given as the sum of restitutive force $Q_s$ of only the frame composed of columns and beams in a story installed with the variable damping device and damping force F generated from the variable damping device such as to permit a variation of stiffness from 0 to K in relation to the earthquake-resisting component, finding a form parameter $\alpha=Q_0/(K_f \cdot D)$, which is concerned with a characteristic of story restitutive force representing the relation between story amplitude D and story restitutive force Q in a certain vibration state and provides, on a coordinate plane, a characteristic of story restitutive force such as to maximize energy absorption property in reference to a plurality of arbitrary story restitutive forces $Q_0$ controllable by the variable damping device, in response to the kaleidoscopic state of vibration on the basis of frequency transfer characteristics of a target story in response to an earthquake or wind; finding a natural period T of the structure when each of the plurality of form parameter $\alpha$ thus found is respectively selected; and controlling the damping force F generated from the variable damping device so as to provide a form parameter $\alpha$ which enables unresonance as much as possible, in response to a kaleidoscopic change of the state of vibration.

The mode described at first is concerned with control so as to maintain the form parameter $\alpha$ substantially constant in response to the kaleidoscopic change of the state of vibration, whereas in this embodiment, the form parameter $\alpha$ is selectively varied in the mode of giving priority to unresonance so as to attain high damping capacity in the range of a variation of form parameter. Even in this case, efficient seismic response control is enabled according to a simple control rule by seizing the characteristic of story restitutive force corresponding to each form parameter $\alpha$ in advance.

The variable damping device may be installed in a base isolation story of a base isolation structure, instead of the frame composed of columns and beams as described above. That is, in this case, a seismic response control method comprises the steps of installing a variable damping device in a base isolation story of horizontal stiffness $K_f$, which supports an upper structure on a foundation through a horizontal spring component (most generally, laminated rubber, for instance), in parallel to the horizontal spring component; in reference to a characteristic of story restitutive force based on story restitutive force Q $(=Q_s+F)$ given as the sum of restitutive force $Q_s$ of only the horizontal spring component in the base isolation story installed with the variable damping device and damping force F generated from the variable damping device such as to permit a variation of stiffness from 0 to k, selecting a specified characteristic of story restitutive force which represents the relation between story amplitude D(t) and story restitutive force Q(t) such as to optimize energy absorption property or response reduction effects within a range controllable by the variable damping device, in response to the kaleidoscopic state of vibration on the basis of frequency transfer characteristics of the base isolation story in response to an earthquake or wind; and controlling the damping force F generated from the variable damping device so as to maintain the characteristic of story restitutive force, which is shown on a coordinate plane, in the form of a quasi-similar figure, in response to a kaleidoscopic change of the state of vibration.

Otherwise, it may comprise the steps of installing a variable damping device in a base isolation story of horizontal stiffness $K_f$, which supports an upper structure on a foundation through a horizontal spring component, in parallel to the horizontal spring component; in reference to a characteristic of story restitutive force based on story restitutive force Q ($=Q_s+F$) given as the sum of restitutive force $Q_s$ of only the horizontal spring component in the base isolation story installed with the variable damping device and damping force F generated from the variable damping device such as to permit a variation of stiffness from 0 to k, finding a form parameter $\alpha=Q_0/(K_f \cdot D)$, which is concerned with a characteristic of story restitutive force representing the relation between story amplitude D and story restitutive force Q in a certain vibration state, and provides, on a coordinate plane, a characteristic of story restitutive force such as to maximize energy absorption property in reference to a plurality of arbitrary story restitutive forces $Q_0$ controllable by the variable damping device, in response to the kaleidoscopic state of vibration on the basis of frequency transfer characteristics of the base isolation story in response to an earthquake or wind; selecting a specified form parameter $\alpha$ such as to optimize energy absorption property or response reduction effects among a plurality of form parameters $\alpha$ thus found; and controlling the damping force F generated from the variable damping device so as to maintain the form parameter $\alpha$ substantially constant, in response to a kaleidoscopic change of the state of vibration.

Still otherwise, it may comprises the steps of installing a variable damping device in a base isolation story of stiffness $K_f$, which supports an upper structure on a foundation through a horizontal spring component, in parallel to the horizontal spring component; in reference to a characteristic of story restitutive force based on story restitutive force Q ($=Q_s+F$) given as the sum of restitutive force $Q_s$ of only the horizontal spring component in the base isolation story installed with the variable damping device and damping force F generated from the variable damping device such as to permit a variation of stiffness from 0 to k, finding a form parameter $\alpha=Q_0/(K_f \cdot D)$, which is concerned with a characteristic of story restitutive force representing the relation between story amplitude D and story restitutive force Q in a certain vibration state and provides, on a coordinate plane, a characteristic of story restitutive force such as to maximize energy absorption property in reference to a plurality of story restitutive forces $Q_0$ controllable by the variable damping device, in response to the kaleidoscopic state of vibration on the basis of frequency transfer characteristics of the base isolation story in response to an earthquake or wind; finding a natural period T of the structure when each of the plurality of form parameter $\alpha$ thus found is respectively selected; and controlling the damping force F generated from the variable damping device so as to provide a form parameter $\alpha$ which enables unresonance as much as possible, in response to a kaleidoscopic change of the state of vibration.

On the other hand, as the result of noting a difference between frequency transfer characteristics or response of a structure to seismic vibration input from the ground and frequency transfer characteristics or the like of a structure to wind directly input to each story of the structure, a seismic response control method may further comprise the steps of setting a characteristic of story restitutive force of a target story in response to an earthquake and a characteristic of story restitutive force of the target story in response to wind independently of each other; providing a judgment means to select between the characteristic of story restitutive force in response to the earthquake and the characteristic of story restitutive force in response to the wind on the basis of a detected seismic load and a detected wind load; and performing control on the basis of the characteristic of story restitutive force selected by the judgment means. These steps may be applied to the above-described modes or modes which will be described later.

As described above, according to the present invention, as the result of preliminarily setting the specified characteristic of story restitutive force which represents the relation between story amplitude and story restitutive force such as to optimize energy absorption property or response reduction effects on the basis of the frequency transfer characteristics of the target story, and controlling the damping force generated from the variable damping device so as to control the characteristic of story restitutive force in response to a kaleidoscopic change of the state of vibration, efficient seismic response control which is hardly affected by the state of vibration such as a vibration level and a vibration period is enabled with more simplified installation and device than those in the active seismic response control method of the prior art.

Further, a control rule may be simplified by setting the form parameter concerned with the characteristic of story restitutive force. Further, since the variable damping device may be controlled on the basis of only a state value of the device part and also controlled on a story basis, independently of the other story, control is enabled with a simple device configuration.

A seismic response control method for a structure according to the present invention is applied to a case of installing an actuator functioning as a seismic response control device in a structural component (a frame composed of columns and beams or a base isolation story) of stiffness $K_f$ in a structure; setting a specified characteristic of restitutive force such as to attain high energy absorption property or the like in the relation between amplitude D and restitutive force Q, in consideration of the performance of the actuator, the control efficiency and the frequency transfer characteristics of the structural component or the like; and then controlling control force F generated from the actuator so as to maintain the form of the characteristic of restitutive force, in response to the kaleidoscopic state of vibration.

The characteristic of restitutive force in this case is determined on the basis of story restitutive force Q ($=Q_f+F$) given as the sum of restitutive force $Q_s$ of only the structural component portion such as a frame composed of columns and beams in a story and a base isolation story installed with an actuator and control force F generated from the actuator.

A seismic response control method according to one mode of the present invention in this case comprises the steps of installing an earthquake-resisting component in a frame of stiffness $K_f$ composed of columns and beams through an actuator functioning as a seismic response control device; and controlling a characteristic of story restitutive force based on story restitutive force Q (=$Q_s$+F) given as the sum of restitutive force $Q_s$ of only the frame composed of columns and beams in a story installed with the actuator and control force F generated from the actuator such as to act as restitutive force between the frame composed of columns and beams and the earthquake-resisting component, so as to maintain the characteristic of story restitutive force, which is shown on a coordinate plane as the relation between story amplitude D(t) and story restitutive force Q(t), in the form of a quasi-similar figure, in response to the kaleidoscopic state of vibration. According to this method, efficient seismic response control which is hardly affected by the state of vibration such as a vibration level and a vibration period is enabled with more simplified installation and device than those in the active seismic response control method of the prior art.

Further, the actuator may be installed in a base isolation story of a base isolation structure, instead of the frame composed of columns and beams as described above. A seismic response control method according to this mode comprises the steps of installing an actuator functioning as a seismic response control device in a base isolation story of stiffness $K_f$, which supports an upper structure on a foundation through a horizontal spring component, in parallel to the horizontal spring component; and controlling a characteristic of story restitutive force based on story restitutive force Q (=$Q_f$+F) given as the sum of restitutive force $Q_s$ of only the horizontal spring component in the base isolation story installed with the actuator and control force F generated from the actuator, so as to maintain the characteristic of story restitutive force, which is shown on a coordinate plane as the relation between story amplitude D and story restitutive force Q, in the form of a quasi-similar figure, in response to the kaleidoscopic state of vibration.

It is ideal for a characteristic of story restitutive force shown on the coordinate plane to take the form of a rectangle from the standpoint of the characteristic of story restitutive force. However, when it is difficult to maintain the characteristic in the form of a rectangle in view of the performance of the actuator or its control aspect, it is necessary to selectively determine a form which is excellent in energy absorption property as much as possible and enables stable control by means of adding a confined value to the form of the characteristic of story restitutive force and so on. For instance, the characteristic of story restitutive force shown on the coordinate plane is confined to maintain a form resulting from adding a confined value proportional to velocity to a quasi-rectangle symmetrical about axes of ordinate and abscissa. This is an instance of a way of providing a confined value, and particularly takes stability of control into consideration. That is, actual seismic vibration has very complicated waveform such as to suddenly change the course of deformation in vibration. Thus, the confined value proportional to velocity may be added to enable highly stable control corresponding to the actual seismic vibration, and to lighten a load of the actuator.

In this manner, as the result of setting the specified characteristic of story restitutive force, ideally, the characteristic of story restitutive force in the form of rectangle, which represents the relation between story amplitude and story restitutive force such as to optimize energy absorption property or response reduction effects in the story installed with the actuator, and controlling the control force generated from the actuator so as to maintain the characteristic of story restitutive force in the form of a similar figure, in response to a kaleidoscopic change of the state of vibration, efficient seismic response control which is hardly affected by the state of vibration such as a vibration level and a vibration period is enabled with more simplified installation and device than those in the active seismic response control method of the prior art.

Further, a control rule connected with the characteristic of restitutive force may be simplified. Further, since the actuator may be controlled on the basis of only a state value of the device part, and also controlled on a story basis, independently of the other story, control is enabled with a simple device configuration.

Further, a seismic response control method for a structure according to the present invention is applied to a case of using a variable damping device as a damper incorporated in a dynamic vibration absorber for control according to a concept of hysteresis control.

That is, a variable damping device permitting a variation of damping coefficient is used as a damper of a dynamic vibration absorber, which has been installed as the passive seismic response control device on the top or inside of a structure, and a control means such as a computer and a control circuit is operated to simply control the variable damping device for seismic response control based on so-called semi-active control.

According to one mode in this case, as the dynamic vibration absorber incorporated with the variable damping device as described above, use is made of a device, in which a structure and a weight horizontally movable in parallel to the structure are connected together through a spring and also a variable damping device. The spring is basically used for synchronizing the vibration of the weight with the vibration of the structure, similarly to the case of the dynamic vibration absorber in the prior art. However, a stiffness of a variable damping device part varies from 0 to $k_d$ according to the control state of the variable damping device, and exerts an influence on a period as that of a non-linear dynamic vibration absorber, and therefore, it is necessary to compositely analyze and set the spring and the variable damping device.

With the non-linear dynamic vibration absorber as described above, the variable damping device is controlled to provide low damping capacity in the initial stage of a response of the structure to disturbance, and subsequently controlled to provide higher damping capacity with an increase of the response of the structure. Accordingly, a rise of the dynamic vibration absorber in the initial stage of vibration is improved to reduce the response of the structure in the early stage.

On the basis of the above concept, as the result of noting a characteristic of restitutive force of the dynamic vibration absorber incorporated with the variable damping device, seismic response control may be performed in the form of hysteresis control.

Specifically, its first step is to determine a characteristic of restitutive force in response to the vibration of the weight in the dynamic vibration absorber part. This characteristic of restitutive force may be determined on the basis of restitutive force Q (=$Q_s$+F) given as the sum of restitutive force $Q_s$ of only the spring and damping force F generated from the variable damping device.

The successive step is to determine a characteristic of restitutive force such as to optimize energy absorption property in reference to a plurality of arbitrary restitutive forces $Q_0$ within a range controllable by the variable damping device, as a characteristic of restitutive force which represents the relation between weight amplitude D and restitutive force Q in the kaleidoscopic state of vibration, and to find a form parameter $\alpha=Q_0/(K\cdot D)$ which provides the determined characteristic of restitutive force on a coordinate plane.

That is, the structure is affected by disturbance such as an earthquake and wind, and as a result, the weight amplitude D kaleidoscopically varies in a process of seismic response control. However, on condition that a value of the form parameter $\alpha$ is fixed, the characteristic of restitutive force (hysteresis form) is maintained in the form of a similar figure on a coordinate plane.

In this case, according to the present invention, control is performed so as to provide a characteristic of restitutive force corresponding to a value $\alpha_1$ (for instance, $\alpha_1=0$) which provides low damping capacity in the initial stage of the response of the structure to the disturbance, and to successively provide a characteristic of restitutive force corresponding to a value $\alpha_2$ (for instance, $\alpha_2=1$) which provides high damping capacity with an increase of the response of the structure.

As the result of the above control, a rise of the dynamic vibration absorber is improved in the initial stage of vibration, and it is possible to display the capacity concerned with damping property in the variable damping device to the maximum, while simplifying a control rule by the application of hysteresis control.

Further, the stiffness K of the spring is preset to be lower than the stiffness $K_0$ which allows the vibration of the weight to synchronize with the vibration of the structure in case of installing no variable damping device, the vibration period of the weight is preset to be longer than the natural period of the structure, and the form parameter $\alpha$ is shifted from a value $\alpha_1$ which provides low damping capacity (at this time, the stiffness $K_1$ resulting from adding the stiffness of the spring part of the variable damping device and that of the variable damping device part has a relation of $K<K_1<K_0$) to a value $\alpha_2$ which provides high damping capacity (at this time, the stiffness $K_2$ resulting from adding the stiffness of the spring part of the variable damping device and that of the variable damping device part has a relation of $K<K_2\approx K_0$). As a result, the weight vibration period determined by the spring stiffness K and the parameter $\alpha$ may be set so as to be close to the natural period $T_0$ of the structure.

Table 1 shows stiffness, period and damping capacity when a form parameter $\alpha$ selected in the initial stage of vibration is defined as 0, and a form parameter selected in a period of duration of seismic response control is defined as 1.

TABLE 1

| | Initial stage of vibration | Duration of seismic response control |
|---|---|---|
| Form parameter | $\alpha = 0$ | $\alpha = 1$ |
| Stiffness | $K_1 < K_0$ | $K_2 \approx K_0$ |
| Period | $T_1 > T_0$ | $T_2 > T_0$ |
| Damping capacity | low | high |

As is read from the above table, according to the selected form parameter $\alpha$, it is possible to lengthen the period of the dynamic vibration absorber, and to adjust the period in practical mounting.

In this manner, the rise of the dynamic vibration absorber as the seismic response control device in the initial stage of vibration of the structure may be improved, and the effects on seismic response control may be produced in the early stage to restrain an increase of the response, and to produce the effects on reduction of the response in the early stage. Further, since the concept of hysteresis control adopting the form parameter $\alpha$ is applied to the present invention, control is simplified, and efficient control is enabled.

BRIEF DESCRIPTION OF THE DRAWINGS

The foregoing and other objects and features of the invention will become apparent from the following description of preferred embodiments of the invention with reference to the accompanying drawings, in which:

FIGS. 1A to 1C show a basic concept of the present invention, in which FIG. 1A is an elevation schematically showing a device arrangement, FIG. 1B is a view showing a single modeled story of a building, and FIG. 1C is graph showing the relation between story hysteresis characteristic and structural restrictions;

FIGS. 9A to 9C show the results of calculation of envelope waveform D(t), in which FIG. 9A shows a case of NS component in El Centro wave, FIG. 9B shows a case of EW component in Taft wave, and FIG. 9C shows a case of NS component in Hachinohe wave;

FIGS. 10A to 10F are graphs showing the results of analysis on the subject of a characteristic of restitutive force in case of control performed according to the present invention on the basis of story response, in which FIG. 10A shows a case of input seismic vibration consisting of NS component in El Centro wave, FIG. 10B shows a case of input seismic vibration consisting of EW component in El Centro wave, FIG. 10C shows a case of input seismic vibration consisting of NS component in Taft wave, FIG. 10D shows a case of input seismic vibration consisting of EW component in Taft wave, FIG. 10E shows a case of input seismic vibration consisting of NS component in Hachinohe wave, and FIG. 10F shows a case of input seismic vibration consisting of EW component in Hachinohe wave;

FIGS. 11A to 11F are graphs showing the results of analysis on the subject of a characteristic of restitutive force in case of control performed according to the present invention only on the basis of information of a device part, in which FIG. 11A shows a case of input seismic vibration consisting of NS component in El Centro wave, FIG. 11B shows a case of input seismic vibration consisting of EW component in El Centro wave, FIG. 11C shows a case of input seismic vibration consisting of NS component in Taft wave, FIG. 11D shows a case of input seismic vibration consisting of EW component in Taft wave, FIG. 11E shows a case of input seismic vibration consisting of NS component in Hachinohe wave, and FIG. 11F shows a case of input seismic vibration consisting of EW component in Hachinohe wave;

FIGS. 20A to 20C show a basic concept in case of using an actuator instead of a variable damping device, in which FIG. 20A is a schematic elevation showing a device arrangement, FIG. 20B is a view showing a single modeled story of a building, and FIG. 20C is a graph showing a determined characteristic of hysteresis of a story on a coordinate plane;

FIGS. 26A and 26B schematically show an embodiment in case of hysteresis control with a non-linear dynamic vibration absorber including a variable damping device used as a damper incorporated in a dynamic vibration absorber, in which FIG. 26A is a schematic view of a whole system, and FIG. 26B shows the configuration of a non-linear dynamic vibration absorber in the form of a dynamic model;

DESCRIPTION OF THE PREFERRED EMBODIMENTS

Hysteresis control applied to the present invention relates to a method of controlling a characteristic of story restitutive force in a seismic response controlled structure, in which a variable damping device is installed inside a frame composed of columns and beams (which will be hereinafter simply referred to as a frame) through a brace or like earthquake-resisting component (which will be hereinafter simply referred to as a brace), or a variable damping device is installed in a base isolation story of a base isolation structure so as to be in parallel to a horizontal spring component such as a laminated rubber support and so on.

Figure 1A:
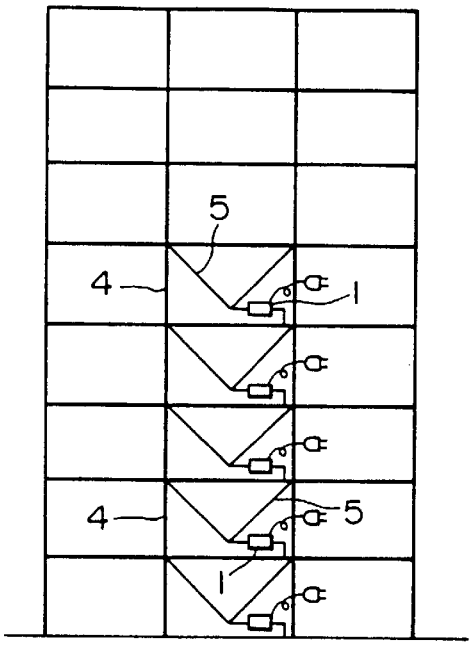
Figure 1B:
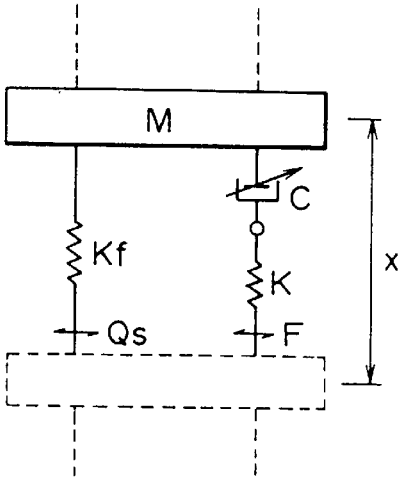

The characteristic of story restitutive force represents the relation between the sum Q ($=Q_s+F$) of restitutive force of the frame and damping force from the device and a story deformation x in a dynamic model shown in FIG. 1B, for instance.

Incidentally, in FIG. 1B, $K_f$ denotes a frame stiffness, K denotes a brace stiffness (including a stiffness of the variable damping device), and c denotes a damping coefficient (variable).

Figure 1C:
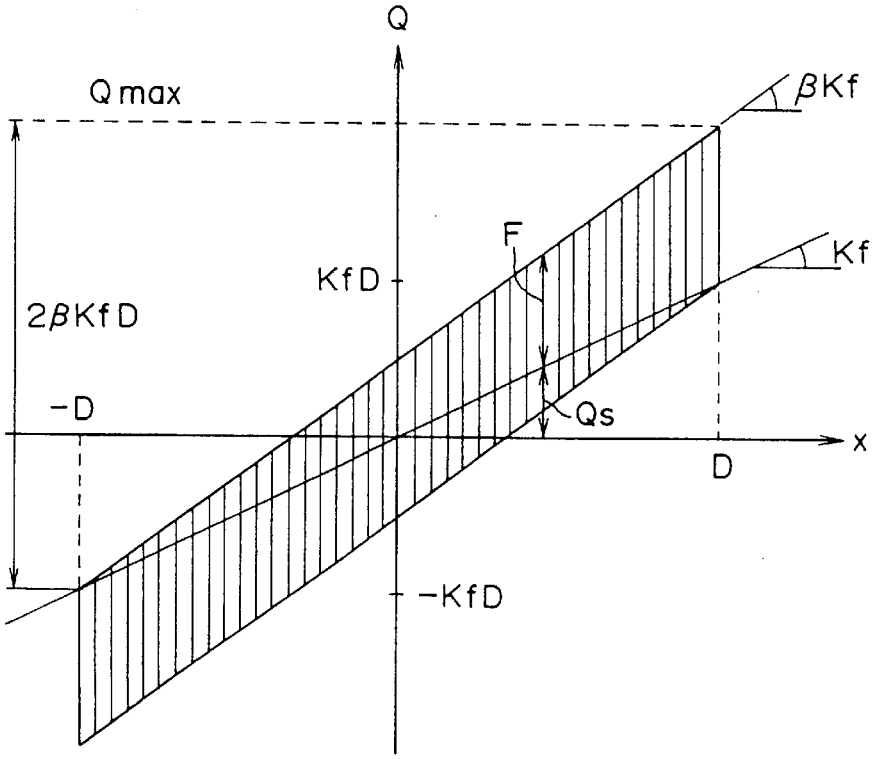
Figure 2A:
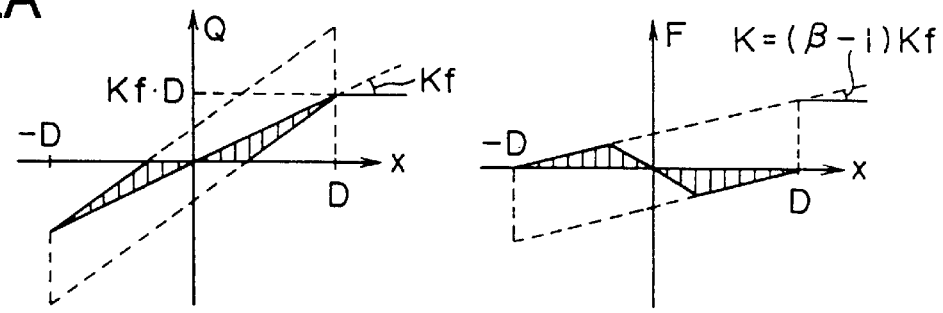
FIG. 2 shows graphs in reference to five kinds of from parameters $\alpha$ of 0 to 2.0, in which graphs on the left side respectively show the relation (characteristic of restitutive force) between story restitutive force Q and story deformation x, and graphs on the right side respectively show the relation between damping force F generated from a variable damping device and story deformation x.
Figure 2B:
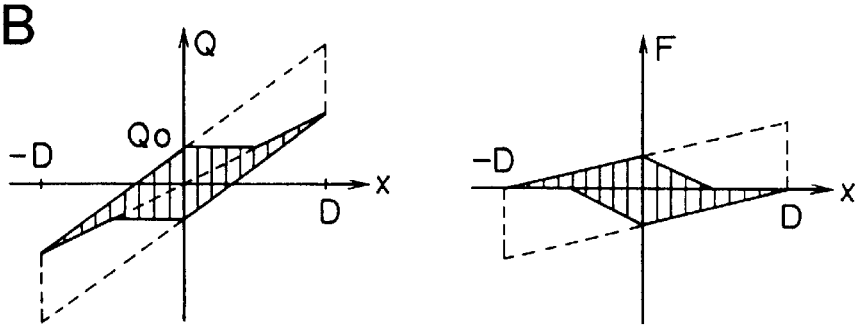
Figure 2C:
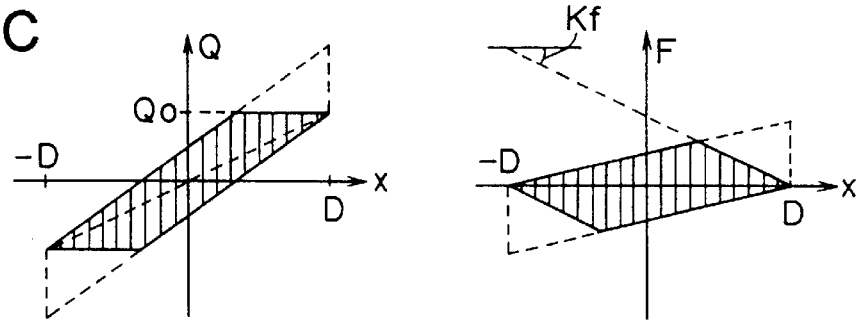
Figure 2D:
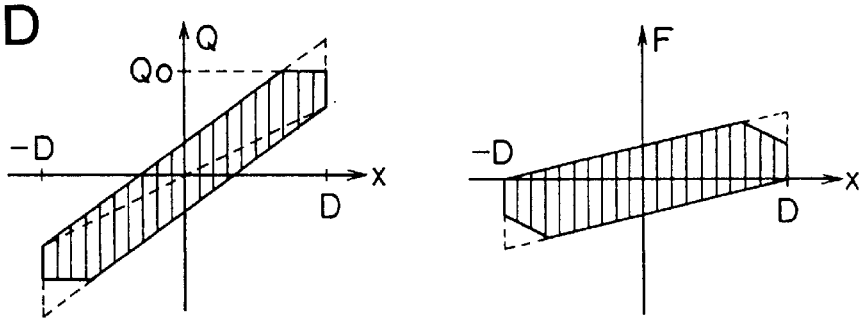
Figure 2E:
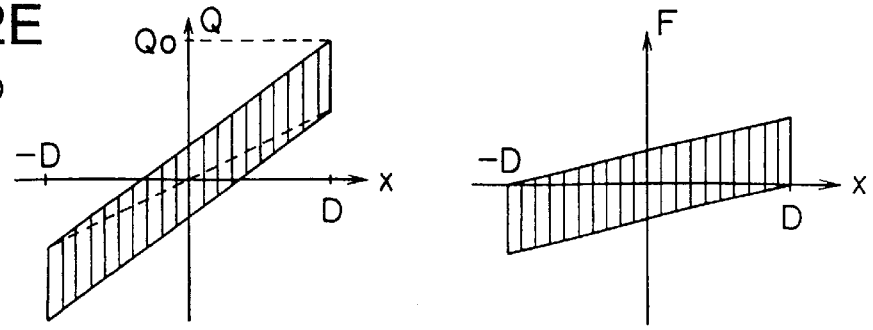

In a variable damping system when a building is subjected to stationary vibration at an amplitude D, the characteristic of restitutive force in this system is limited to only a parallelogram range shown by hatching in FIG. 1C, according to structural restrictions that a variable dashpot is applied to the device.

In FIG. 1C, β denotes a stiffness ratio [$=(K_f+K)/K_f \geqq 1.0$ ] of the stiffness $K_f$ of only the frame to the total stiffness inclusive of the frame stiffness $K_f$ and the brace stiffness K, and $\beta K_f$ represents a gradient of upper and lower sides of the parallelogram.

The features of the present invention are to control a characteristic of restitutive force so as to provide a characteristic of restitutive force of a predetermined form under the above structural restrictions (there are cases where the characteristic of restitutive force is controlled to maintain or vary a similar figure).

In this case, as shown in FIG. 2, for instance, the form of the characteristic of restitutive force is defined in terms of a form parameter $\alpha[=Q_0/(K_f \cdot D)](0 \leqq \alpha \leqq \beta-1$, wherein $Q_0$ represents a predetermined maximum value of restitutive force (acceleration) in case of control of a variable damping device on specific condition that D is fixed).

In FIG. 2, graphs on the left side respectively show the relation (characteristic of restitutive force) between story restitutive force Q and story deformation x, and graphs on the right side respectively show the relation between damping force F generated from the variable damping device and story deformation x in reference to five kinds of form parameters $\alpha$ of, 0, 0.5, 1.0, 1.5 and 2.0 when $\beta$=1.5, i.e., $k/K_f$=0.5.

A basic concept of the present invention is to set a characteristic of restitutive force such as to maximize absorption energy on condition that an amplitude is not more than a certain value D and restitutive force (acceleration) is not more than a certain value $Q_0$ in a certain point of time, and to control the characteristic of restitutive force in response to a kaleidoscopic amplitude D(t).

Figure 3A:
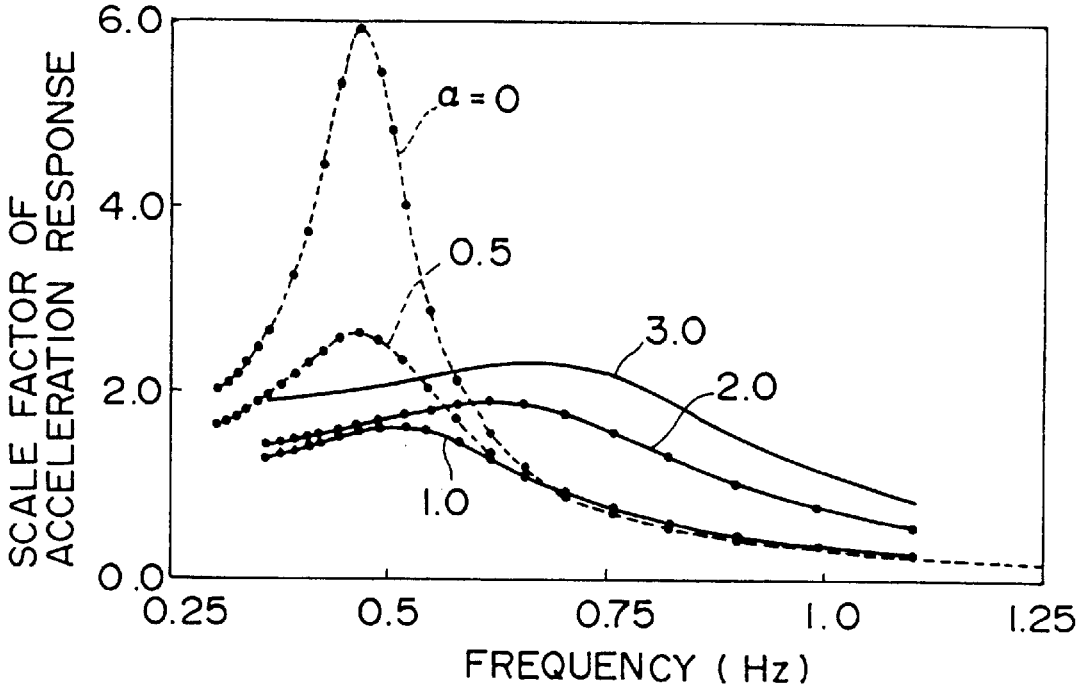
FIG. 3A is a graph showing a scale factor of acceleration response in reference to each case shown in FIG. 2.

When the characteristic of restitutive force is controlled to provide the form as described above, transfer characteristics in response to seismic vibration are provided as shown in FIG. 3 (when a primary natural frequency $f_0$ of a building is 0.5). Incidentally, FIG. 2 shows a case where $\beta$=1.5, whereas FIGS. 3A and 3 B respectively show transfer characteristics corresponding to the form parameters $\alpha$ of 0, 0.5, 1.0, 2.0 and 3.0 when $\beta$=2.0, so as to easily understand the features of the present invention.

Figure 3B:
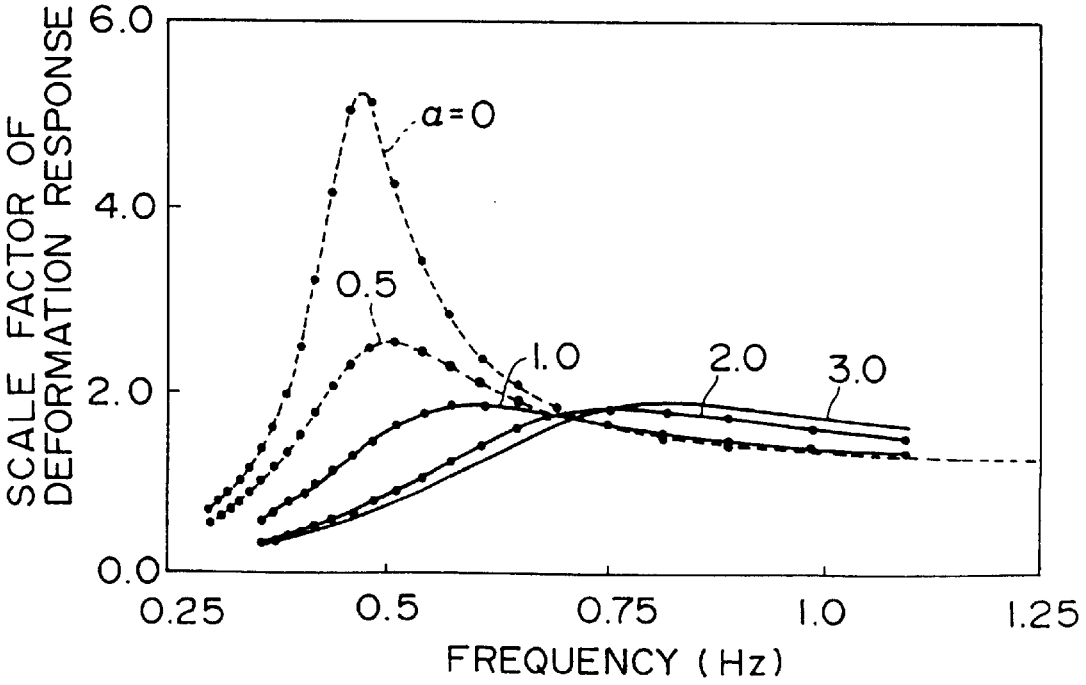
FIG. 3B is a graph showing a scale factor of deformation response in reference to each case shown in FIG. 2.

In FIG. 3A, a frequency is plotted on the axis of abscissa, and a scale factor of acceleration response is plotted on the axis of ordinate. In FIG. 3B, a frequency is plotted on the axis of abscissa, and a scale factor of deformation response is plotted on the axis of ordinate. As is read from the graphs, a peak of the scale factor of acceleration response and a peak of the scale factor of deformation response when $\alpha$=1.0, 2.0 and 3.0 are lower than those when $\alpha$=0 and 0.5, and further, in a high frequency range, the scale factor of response when $\alpha$=0, 0.5 and 1.0 is lower than that when $\alpha$=2.0 and 3.0 (low scale factor of response at a somewhat high frequency in a humanly sensible range is also essential to the seismic response control effects).

In this case, the characteristic of restitutive force in the form of a complete quadrangle (parallelogram) when $\alpha$=1 is judged to be optimal from the scale factor of response in FIGS. 3A and 3B and the degree of damping force F generated from the device as shown in FIG. 2 (actually, a judgment is made with respect to the same $\beta$ of 2.0). Then, this characteristic in the form of a complete quadrangle is defined as a target characteristic of restitutive force.

A description will now be given of a means for realizing the target characteristic of restitutive force.

Figure 4:
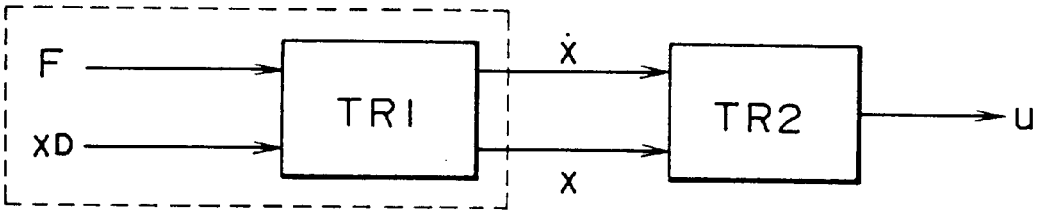
FIG. 4 is a block diagram showing a control means for realizing a target characteristic of restitutive force in the present invention.

First, a control block is set as shown in FIG. 4 for the purpose of controlling to attain the target characteristic of restitutive force, in a non-stationary state when an earthquake occurred and so on.

In FIG. 4, TR1 is used to find a story response on the basis of information of a device part, and TR2 is used to find a control force command value u(t) for realizing the target characteristic of restitutive force on the basis of the story response.

Figure 5:
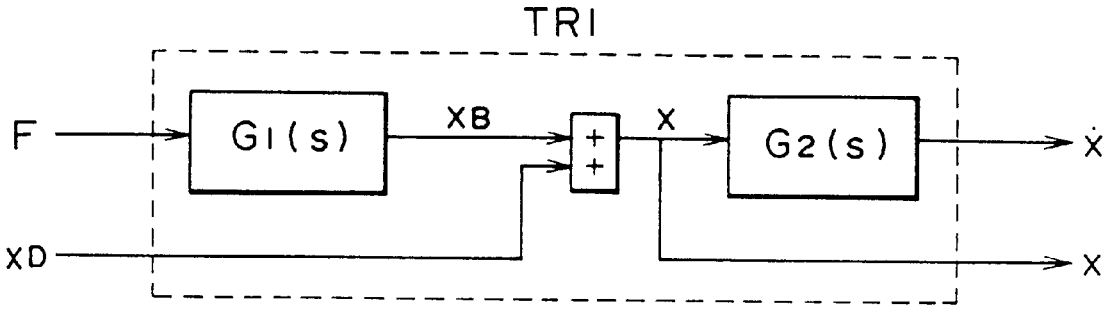
FIG. 5 is a block diagram specifically showing TR1 portion in the block diagram of FIG. 4.

TR1 is used to find a deformation $x_B$ of a brace portion on the basis of the damping force F generated from the device, and also to find a story velocity dx/dt and a story deformation x on the basis of both the deformation $x_B$ and a deformation $X_D$ of a device part. TR1 is expressed in terms of a transfer function as shown in FIG. 5 (transfer characteristics of the deformation $X_D$ of the brace portion are given as $G_1$ (s)=1/(c's+k) on the basis of the damping force F generated from the device, wherein c' denotes damping in the brace portion).

Incidentally, when the story velocity dx/dt and the story deformation x may be directly detected by a sensor mounted on the building side, in addition to the device part, TR1 portion is not always necessary in control.

$G_2$ (s) denotes a differential circuit.

Figure 6:
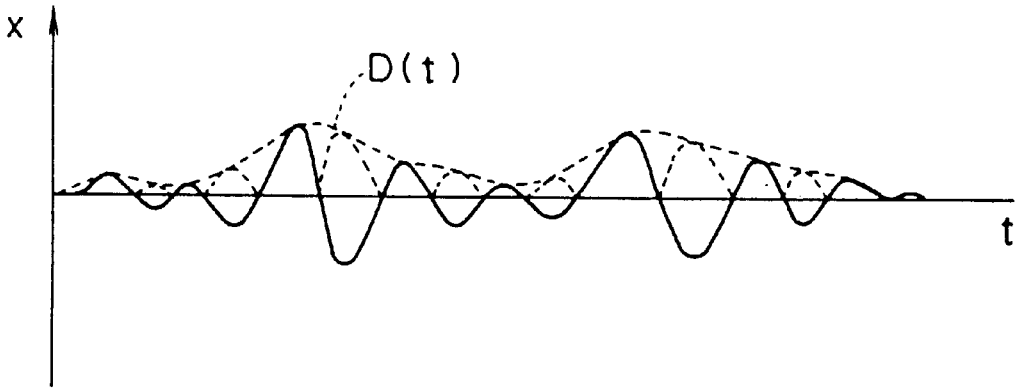
FIG. 6 is a graph showing the relation between kaleidoscopic response of story deformation and its envelope waveform D(t)

Although various methods may be applied to TR2, TR2 in this case is used to find an envelope waveform D(t) of a kaleidoscopic response of story deformation (See FIG. 6), and to create a control command value u(t) on the basis of the envelope waveform D(t) according to the following expression (1).

$$u(t) = -K_f\{x(t) - \alpha \cdot \mathrm{sgn}(x(t)) \cdot D(t)\} \quad (1)$$

$$\left[x(t) = \frac{dx}{dt}\right]$$

In this expression, sgn(dx(t)/dt) is +1 when (dx(t)/dt)≧0, while being −1 when (dx(t)/dt)<0. u(t) $=-K_f\{x(t)-D(t)\}$ when (dx(t)/dt)≧0, while $u(t)=-K_F\{x(t)+D(t)\}$ when (dx(t)/dt)<0.

Figure 7:
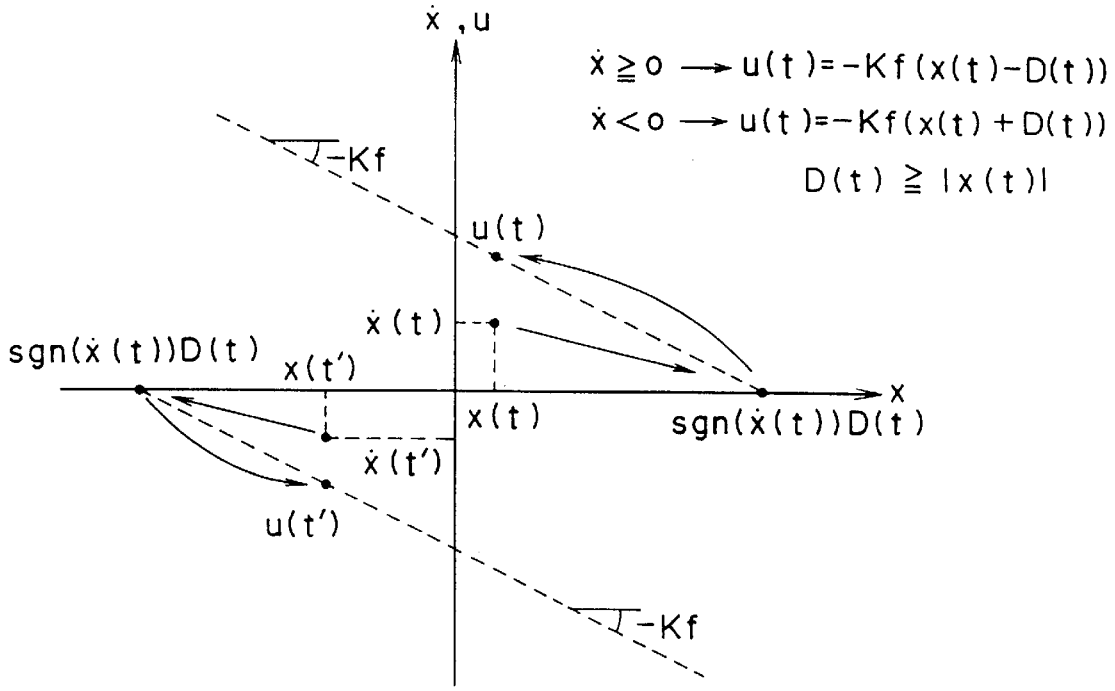
FIG. 7 is a graph for explaining control according to an expression (1) when a from parameter $\alpha$ of 1 is selected.

In this embodiment, the created command value u(t) provides ideal restitutive force which is shown in the form of a rectangle on a coordinate plane. However, a practical characteristic automatically takes the brace stiffness into consideration due to the above structural restrictions (See FIG. 7).

Although various methods may be applied to a way of finding the envelope waveform D(t), the envelope waveform D(t) is defined according to the following expression (2) in this case.

$$D(t)=x^2(t)+x_0^2(t) \quad (2)$$

Wherein x(t) is given by the following expression (3), $$x(t)=-\Sigma Di \cos(\chi it+\phi i) \quad (3)$$

and defines the following expression (4).

$$x_0(t)=\Sigma Di \sin(\chi it+\phi i) \quad (4)$$

Since the expression (4) corresponds to output at a time when the expression (3) is input to the transfer function G'(s), in which an amplitude gain is 1 and a phase is advanced by 90°, it may be sufficient if such a transfer function is created.

Figure 8:
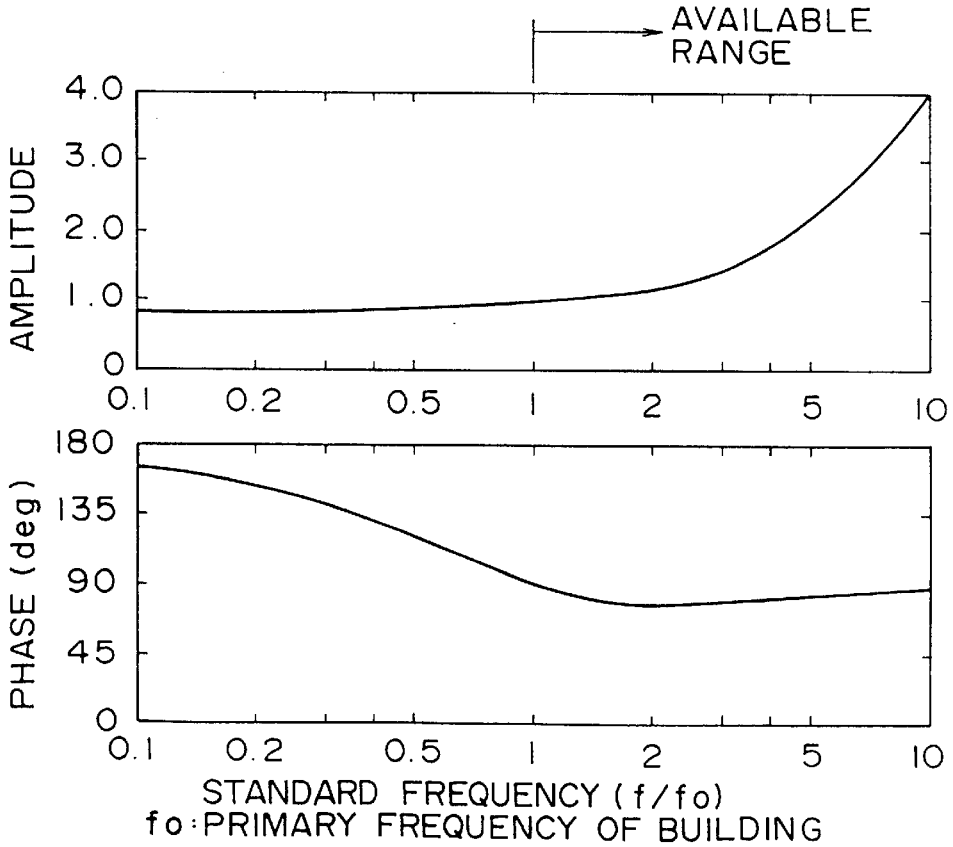
FIG. 8 is a graph showing the relation among a standard frequency, phase and amplitude in a cubic transfer function according to an expression (5) used for finding an envelope waveform D(t)

FIG. 8 shows a characteristic according to a cubic transfer function given by the following expression (5).

$$G'(s) = \frac{ds^3 + es^2 + fs + g}{as^2 + bs + 1} \quad (5)$$

In this expression, items of G'(s) are calculated on condition that $a=0.018T^2$, $b=0.270T$, $d=0.0011T^3$, $e=0.023T^2$, $f=0.088T$ and $g=-0.81$ (T represents a primary natural period of a building).

Figure 9A:
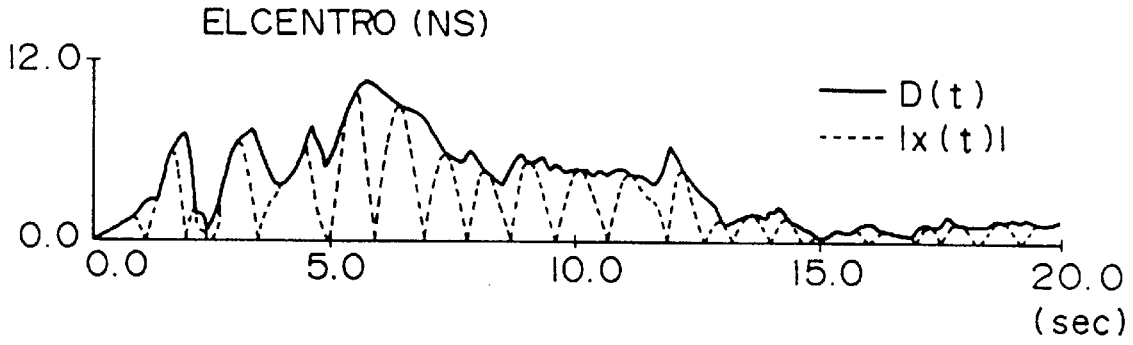
Figure 9B:
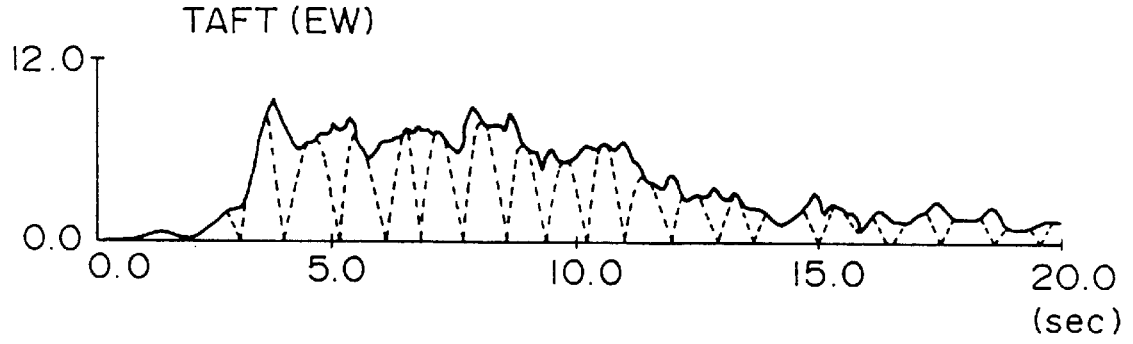
Figure 9C:
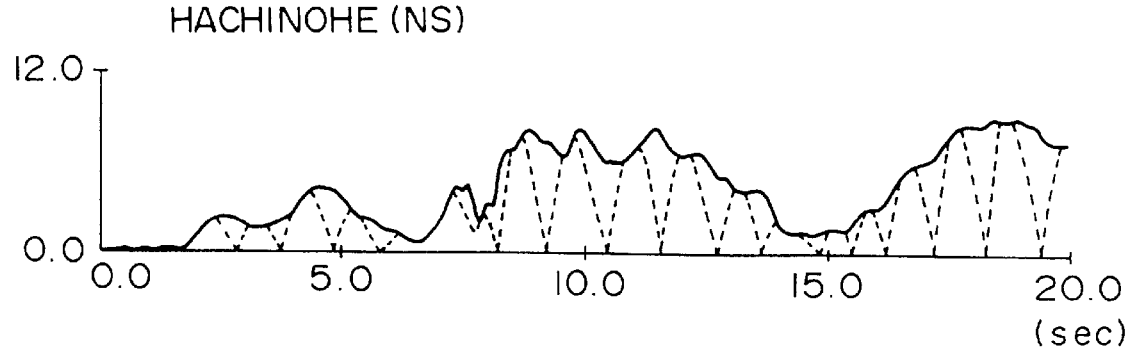

FIGS. 9A to 9C respectively show the results of calculation of D(t), and it is found that the aimed envelope waveform is substantially obtained. As the seismic vibration in case of finding the envelope waveform, NS component in El Centro wave is applied in FIG. 9A, EW component in Taft wave is applied in FIG. 9B, and NS component in Hachinohe wave is applied in FIG. 9C.

Figure 10A:
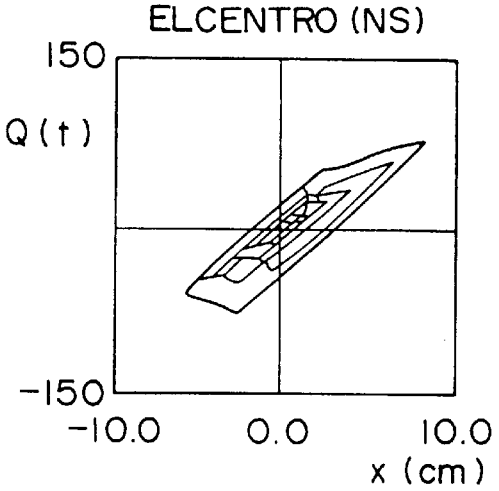
Figure 10B:
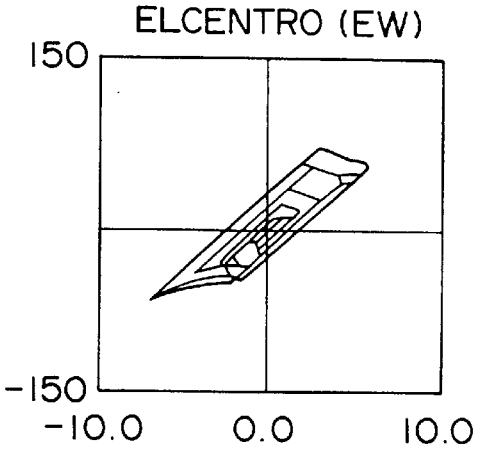
Figure 10C:
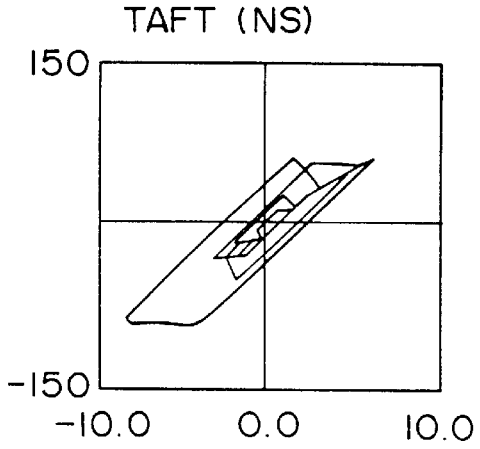
Figure 10D:
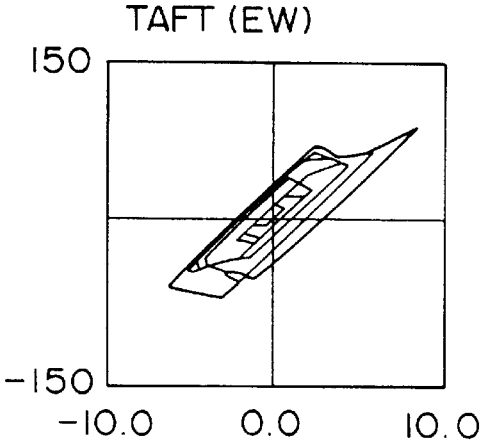
Figure 10E:
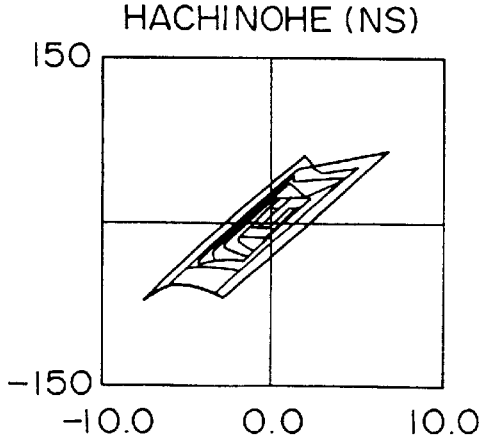
Figure 10F:
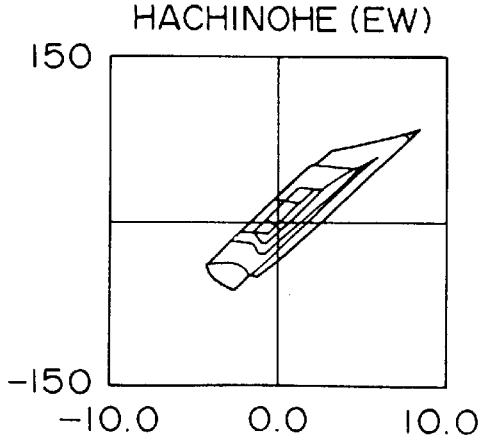
Figure 11A:
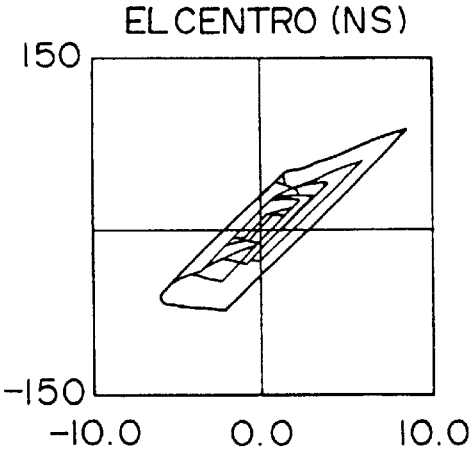
Figure 11B:
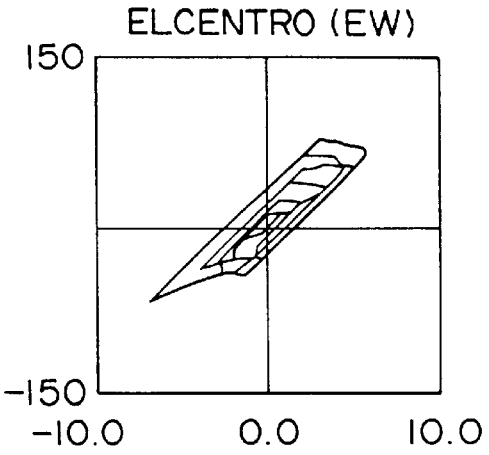
Figure 11C:
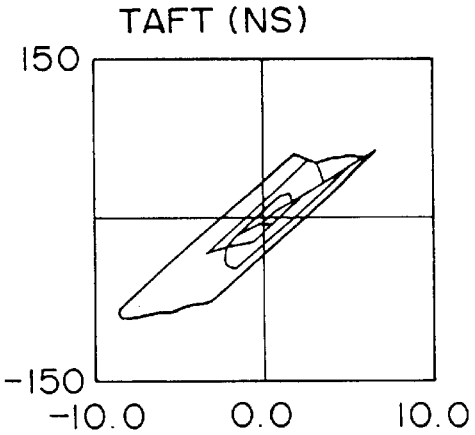
Figure 11D:
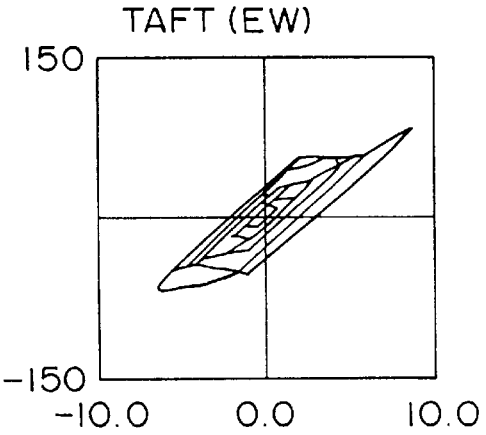
Figure 11E:
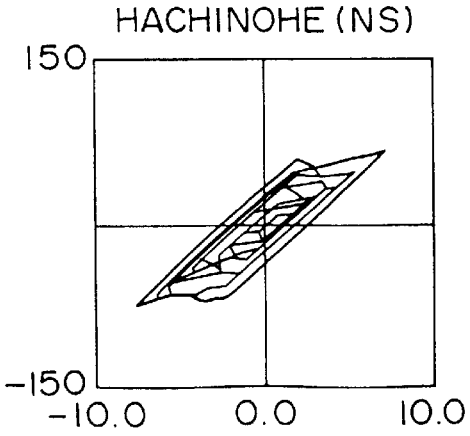
Figure 11F:
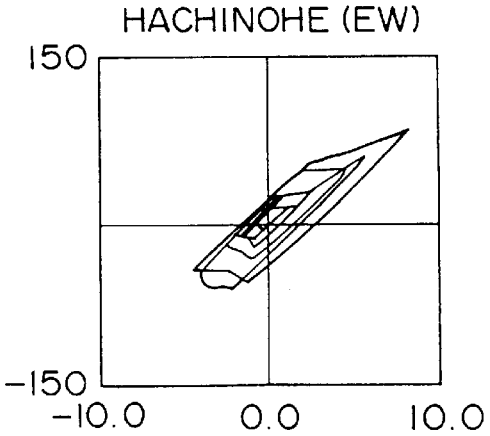

FIGS. 10A to 10F respectively show the characteristic of restitutive force as the result of response analyzed according to the above method (TR2). As is read from these graphs, it is found that the target characteristic of restitutive force is always attained. In these graphs, FIG. 10A shows input seismic vibration consisting of NS component in El Centro wave, FIG. 10B shows input seismic vibration consisting of EW component in El Centro wave, FIG. 10C shows input seismic vibration consisting of NS component in Taft wave, FIG. 10D shows input seismic vibration consisting of EW component in Taft wave, FIG. 10E shows input seismic vibration consisting of NS component of Hachinohe wave, and FIG. 10F shows input seismic vibration consisting of EW component in Hachinohe wave.

FIGS. 11A to 11F respectively show the results of analysis performed with TR1 on the basis of only information of the device part, in contrast with those in FIGS. 10A to 10F, and it is found that the results substantially similar to those in FIGS. 10A to 10F are produced. Accordingly, it is possible to efficiently control the vibration of a structure on the basis of the information content (device pressure and deformation) of only the device part according to the above control method.

The above embodiment relates to a mode of controlling the characteristic of restitutive force so as to maintain a form parameter $\alpha$ substantially constant, that is, to maintain the characteristic of restitutive force (hysteresis form), which is shown on a coordinate plane, in the form of a quasi-similar figure. This mode is to control the available characteristic of story restitutive force with the variable damping device, for the purpose of reducing seismic vibration by absorbing vibration energy of the structure as much as possible.

Figure 12A:
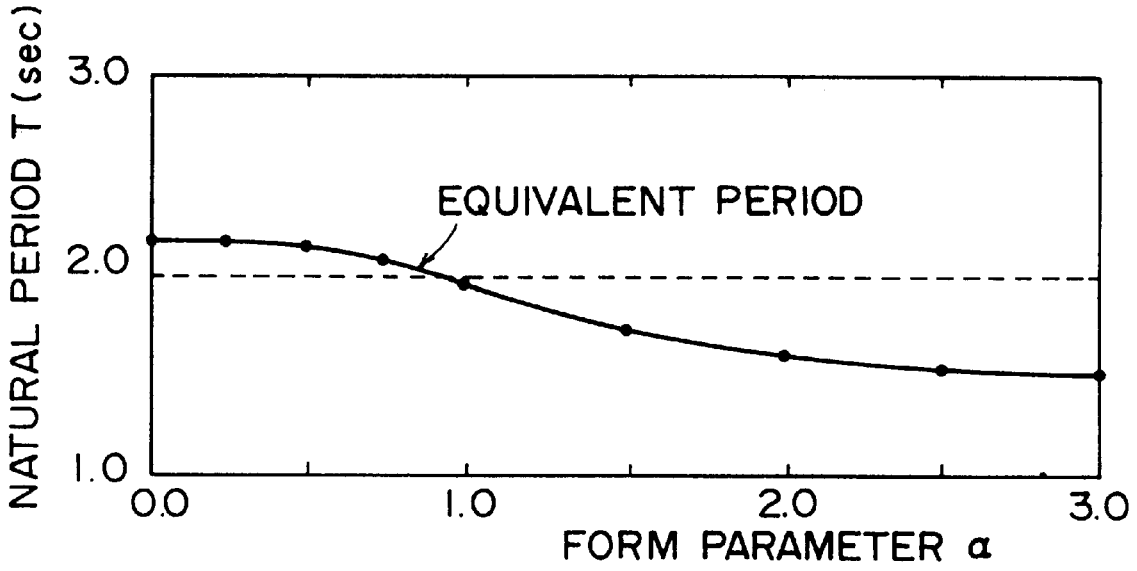
FIG. 12 is a graph showing a variation of a natural period T of a structure and that of a damping factor h when varying a form parameter α under specific conditions.
Figure 12B:
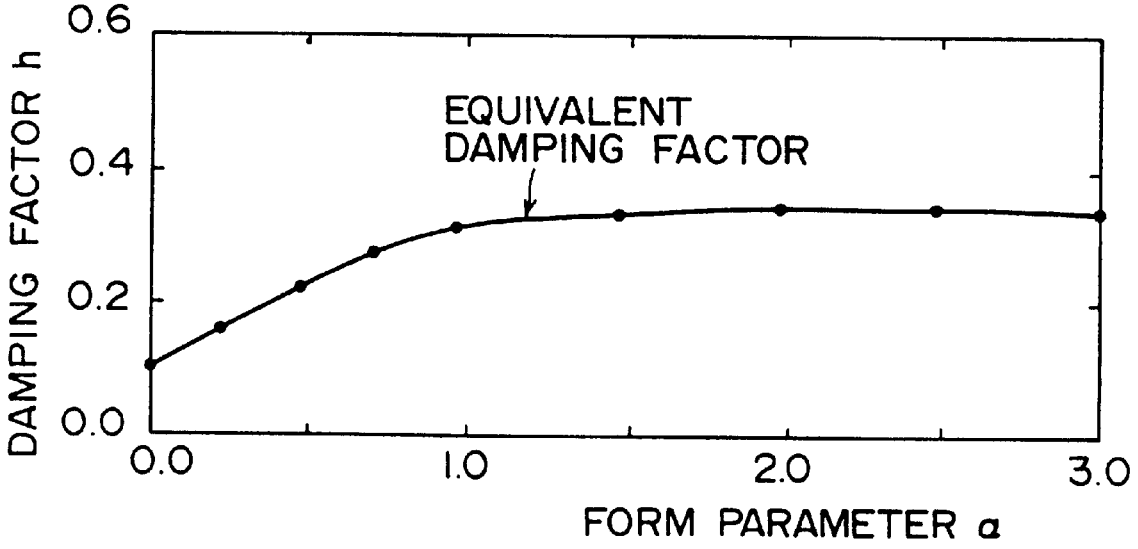

On the other hand, it is possible to vary a natural period and a damping factor of the structure by controlling (varying) the hysteresis form of the structure. FIG. 12 shows a variation of a natural period T (equivalent period) and that of a damping factor h (equivalent damping factor) of the structure when the form parameter $\alpha$ is varied under the specific conditions.

Figure 13:
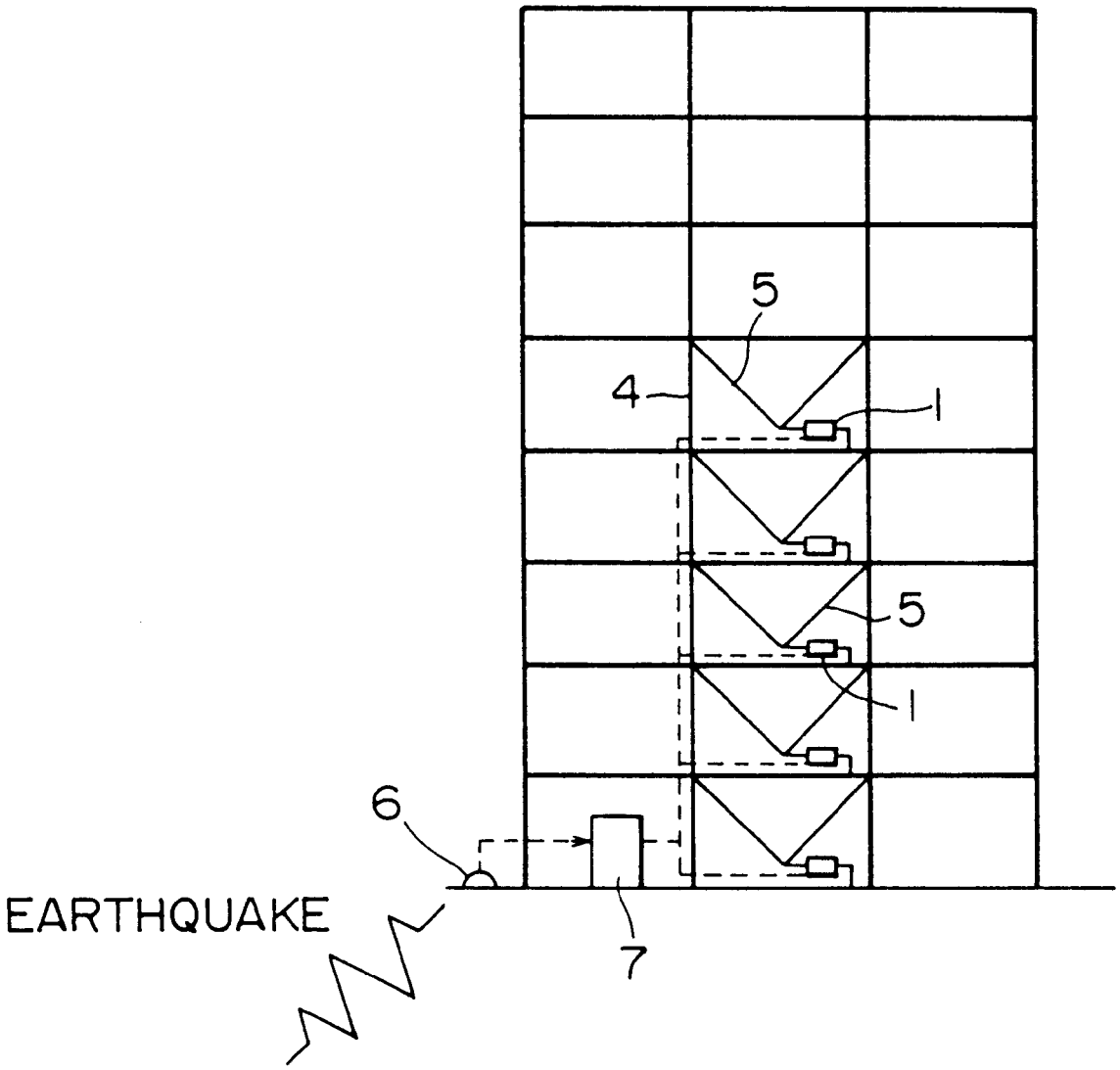
FIG. 13 is a schematic elevation showing a device arrangement when varying a natural period T of a structure according to a variation of a form parameter α.
Figure 14:
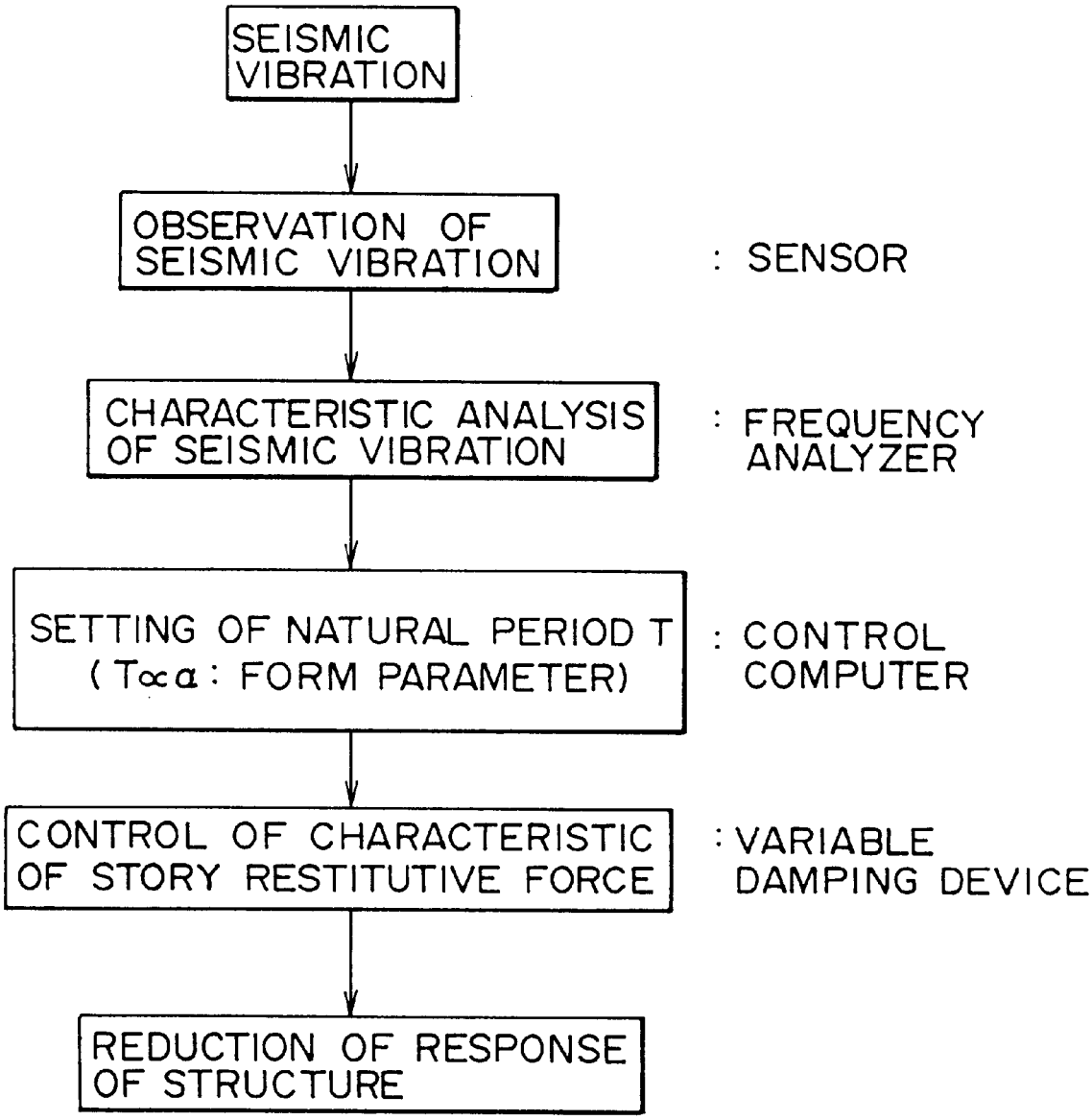
FIG. 14 is a flow chart in case of control by varying a form parameter α.

As shown in FIG. 12, the form parameter $\alpha$ uniquely corresponds to the natural period. Accordingly, in a device arrangement as shown in FIG. 13, for instance, it is possible to control the vibration of the structure in consideration of unresonance on the basis of a control flow in FIG. 14 including the steps of detecting seismic vibration with a sensor 6, selecting a form parameter $\alpha$ which enables unresonance, with a frequency analyzer and a control computer 7 or the like, and then performing control according to a value of the selected form parameter $\alpha$.

That is, it is possible to realize unresonance control such as to vary the natural period of the structure on condition that a high damping factor is added. Further, control of the natural period T of the structure to cause control of unresonance is easily set according to a form parameter $\alpha$ serving as a control parameter. As a result, the seismic vibration of the structure is reduced to attain a safety structure.

In addition to the control mainly in response to the seismic vibration as described above, various form selecting means are conceivable for selecting a form parameter $\alpha$ under a seismic load. On the other hand, since a wind load acts as enforced external force on a mass point of each story in the structure, it may be considered that an individual characteristic of restitutive force should be selected for control under a wind load.

Figure 15:
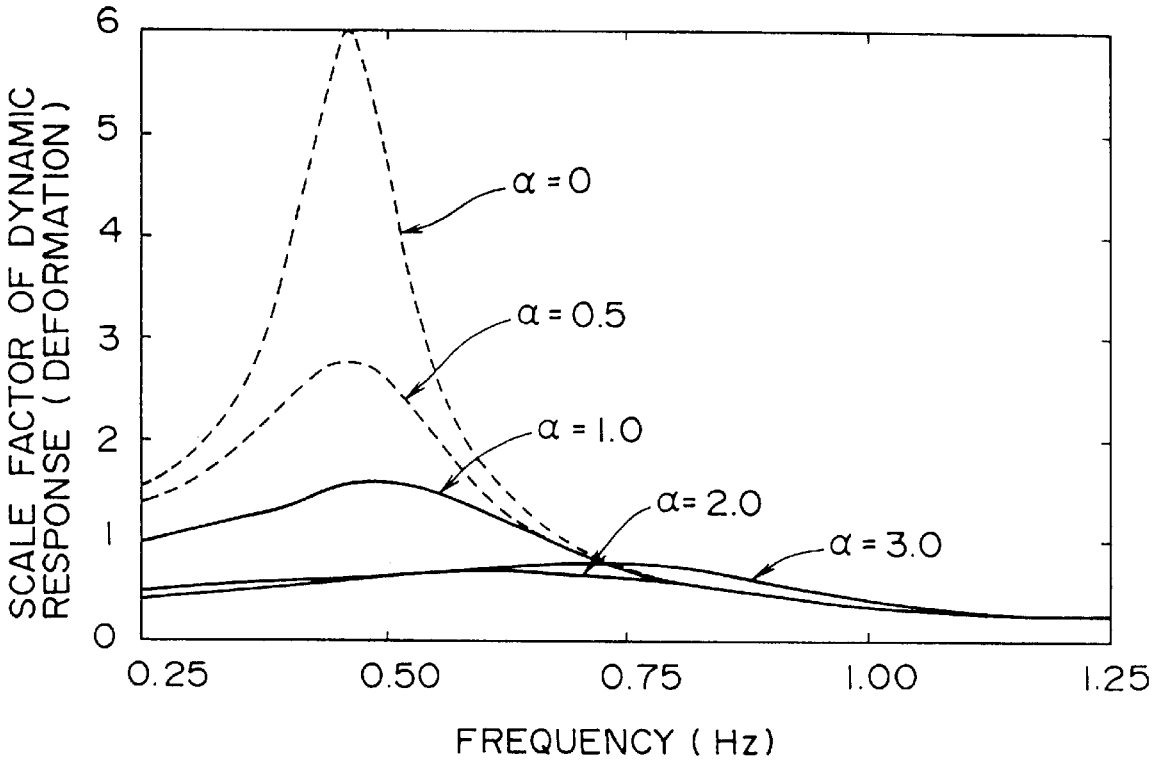
FIG. 15 is a graph showing a transfer function of response reduction effects when varying a form parameter α under a wind load.

FIG. 15 shows a transfer function (provided that when $\beta$=2.0) of the response reduction effects when a form parameter $\alpha$ is varied under a wind load. Although depending on the degree of a natural period inherent in a structure, it may be considered that under such a wind load, it is the most effective to select a form according to a form parameter $\alpha$ of 3.0 ($\alpha$=2.0 in FIG. 2 showing a case where $\beta$=1.5) as a hysteresis form, which represents a characteristic of restitutive force, and to control the hysteresis form so as to maintain a numerical value of the selected form parameter $\alpha$.

Figure 16:
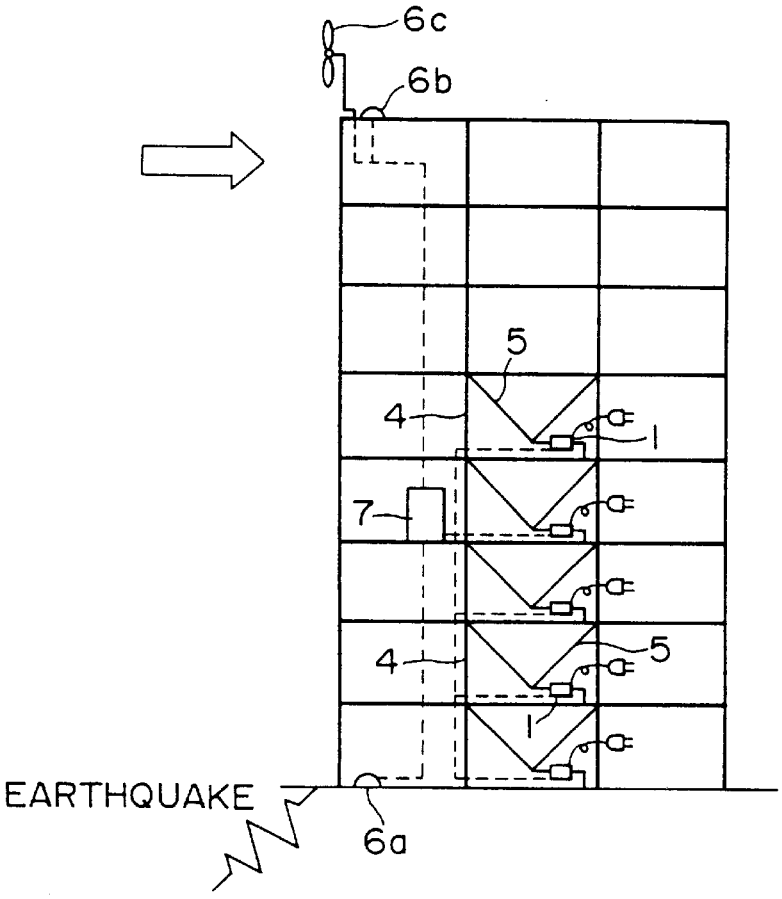
FIG. 16 is a schematic elevation showing a device arrangement in case of switching over between control under a seismic load and that under a wind load.

In this case, control under the seismic load and that under the wind load are switched over on the basis of the measurements with a ground acceleration sensor 6*a* and a top acceleration sensor 6*b* (or a wind gauge 6*c*) as shown in FIG. 16, for instance, and as a result, control according to the kind of external vibration force is enabled.

Incidentally, control under the seismic load and that under the wind load are switched over only by switching over the form parameter $\alpha$.

Figure 17:
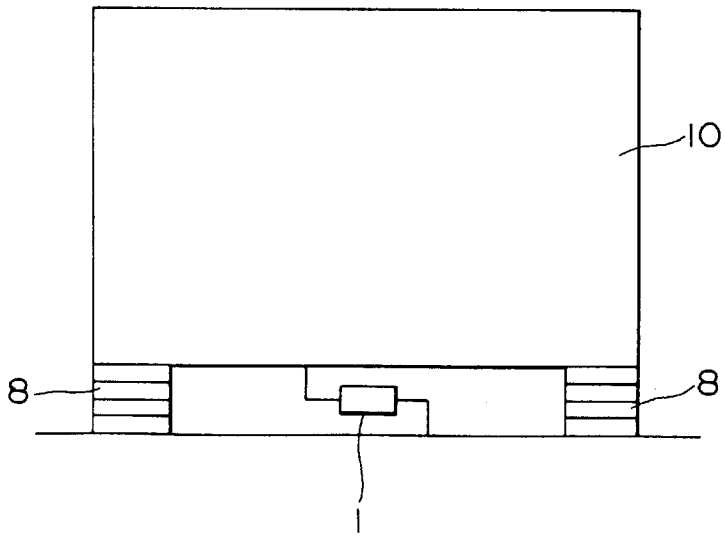
FIG. 17 is an elevation showing an outline in case of control with a variable damping device installed in a base isolation story.
Figure 18:
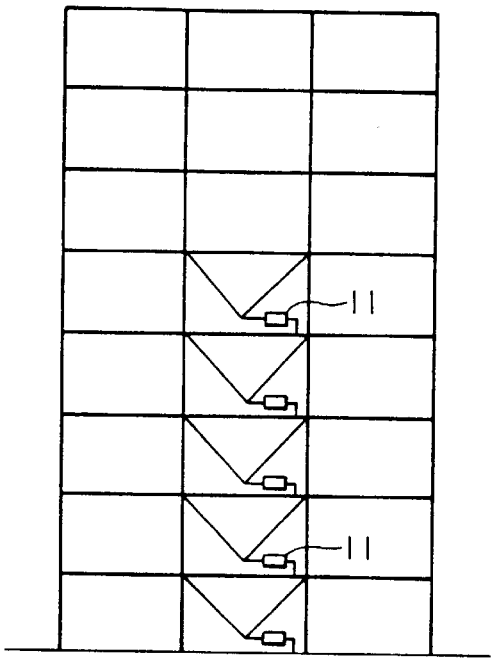
FIG. 18 is a schematic elevation showing a device arrangement in a passive seismic response control method of a prior art adopting a damping device.
Figure 19:
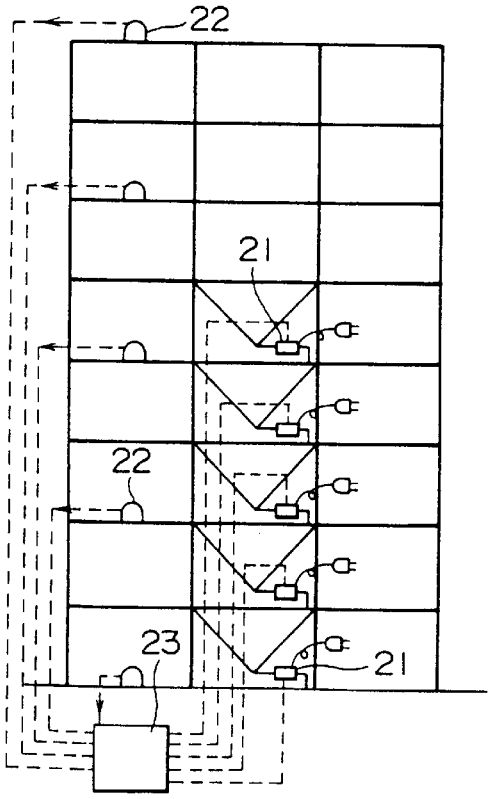
FIG. 19 is a schematic elevation showing a device arrangement in a passive seismic response control method of a prior art adopting a variable damping device.

FIG. 17 shows an outline in case of control with a variable damping device 1 installed in a base isolation story of a base isolation structure 10.

In this case, the horizontal stiffness of a laminated rubber 8 installed on a foundation to support an upper structure is denoted by $K_F$, and the variable stiffness from 0 to k in the variable damping device 1 and its damping coefficient (variable) may be considered to be similar to those when the variable damping device 1 is installed in the frame composed of columns and beams.

Figure 20A:
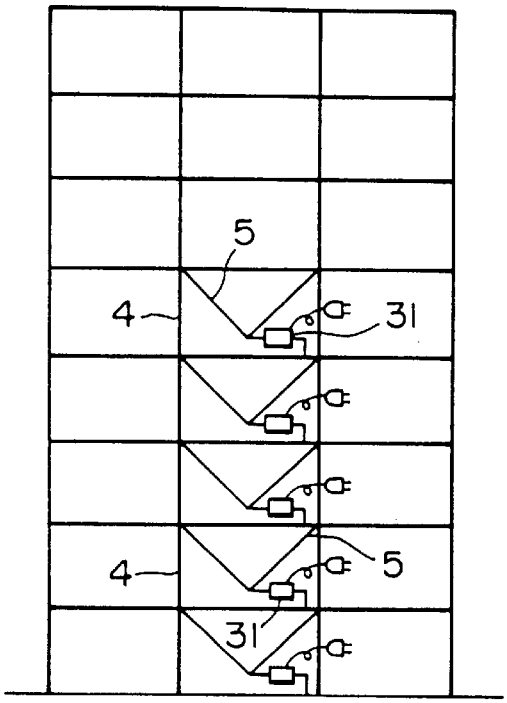

A description will now be given of a case where instead of the above variable damping device of oil damper type, an actuator is used as the seismic response control device, that is, a characteristic of story restitutive force is controlled in the form of hysteresis control with an actuator 31 installed in a frame 4 through an earthquake-resisting component such as a brace 5 (See FIG. 20A) or an actuator 31 installed in a base isolation story of a base isolation structure 10 so as to be in parallel with a horizontal spring component such as a laminated rubber support 8 (See FIG. 25) and so on.

Figure 20B:
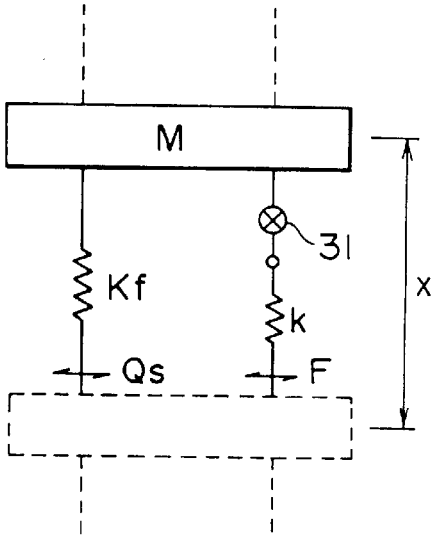

The characteristic of story restitutive force is given as the relation between the sum Q ($=Q_S+F$) of restitutive force $Q_S$ of the frame itself in a dynamic model shown in FIG. 20B, for instance, and control force F generated from the actuator and the story deformation x. In FIG. 20B, $K_F$ denotes a frame stiffness, and K denotes a brace stiffness.

Figure 20C:
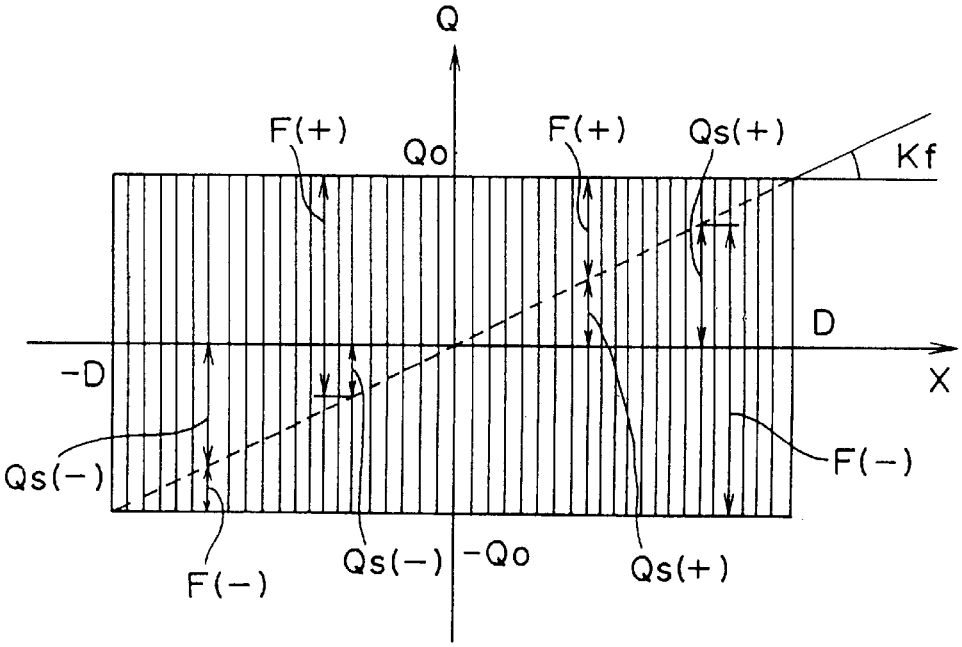

FIG. 20C shows a basic concept of the present invention in a case where a characteristic of restitutive force shown on a coordinate plane is set in the form of a rectangle.

In the drawing, the characteristic of restitutive force of only the frame is linearly given as a broken line, and has a gradient of $K_F$ on the coordinate plane. On the other hand, the characteristic of restitutive force in the form of a rectangle (energy absorption capacity is maximized) is obtained by generating control force F from the actuator. As the result of controlling the characteristic of restitutive force so as to maintain this characteristic in the form of a quasi-rectangle, in response to the kaleidoscopic state of vibration (amplitude D(t)), a control rule may be simplified, regardless of the state of vibration.

Incidentally, in an embodiment shown in FIG. 20C, a rectangle is determined on the basis of the restitutive force $Q_0(t)=K_f \cdot D(t)$ at the amplitude D(t) in case of only the frame, so that the control force F generated from the actuator is varied from 0 to $2Q_0$ in absolute value. However, $Q_0$ is arbitrarily determined, that is, there are some cases where $Q_0$ may be set to be larger than $K_f \cdot D(t)$ (for instance, to be twice as much as $K_f \cdot D(t)$) or lower than $K_f \cdot D(t)$ (for instance, to be half as much as $k_f \cdot D(t)$) depending on the performance of the actuator or the like.

As to the means for realizing the target characteristic of restitutive force, it may be considered that the damping force F generated from the variable damping device is substituted by the control force F generated from the actuator, in the case described with reference to FIGS. 4 and 5.

Incidentally, the command value u(t) created as shown in FIG. 4 provides the ideal restitutive force shown in the form of a rectangle on the coordinate plane. Otherwise, it may be considered that the command value provides a characteristic of restitutive force of a form resulting from adding a confined value to the rectangle in consideration of the performance of the actuator and the stability in control.

Figure 21:
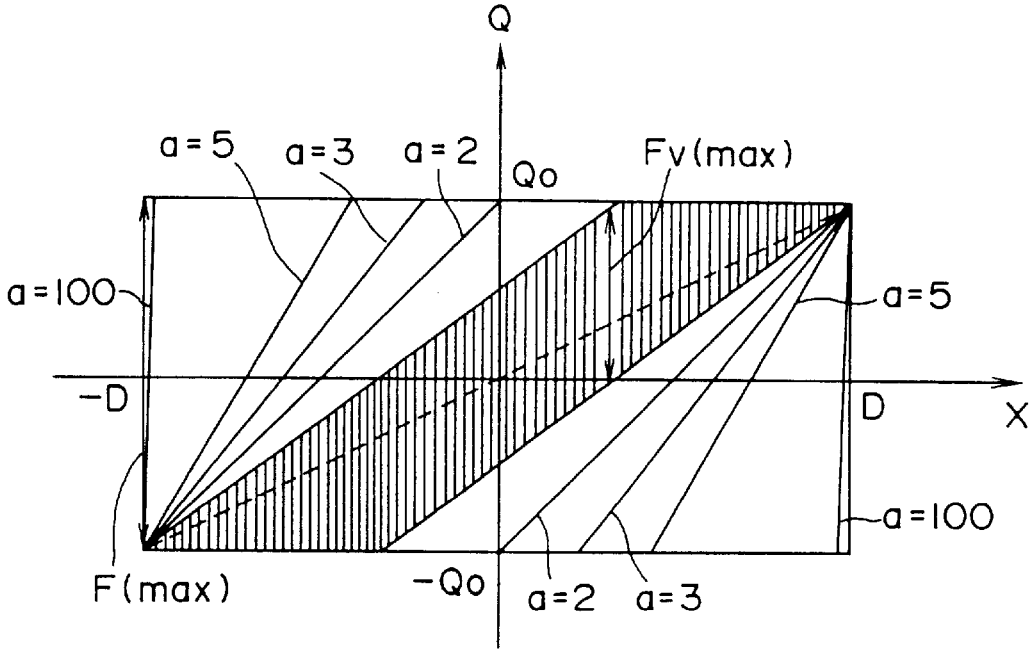
FIG. 21 is a graph showing a hysteresis characteristic in the form of a rectangle on a coordinate plane, on the subject of an available range of a hysteresis characteristic determined by a variable damping device of oil damper type, and hysteresis characteristics a of 2, 3, 5 and 100 in case of using an actuator to generate control force a times as much as available damping force generated from a variable damping device under structural restrictions.

FIG. 21 shows a rectangular characteristic of restitutive force shown on the coordinate plane on the subject of an available range determined by the variable damping device of oil damper type (in a case where $Q_{0=Kf}\cdot D$ is set when $\beta=1.5$), and hysteresis characteristic a of 2, 3, 5 and 100 when the actuator is allowed to generate control force F a times as much as available control force $F_V$ generated from the variable damping device under the structural restrictions. However, a maximum value $F_{(max)}$ of the control force from the actuator does not come to be a times as much as a maximum value $F_{v(max)}$ of the damping force generated from the variable damping device.

Figure 22:
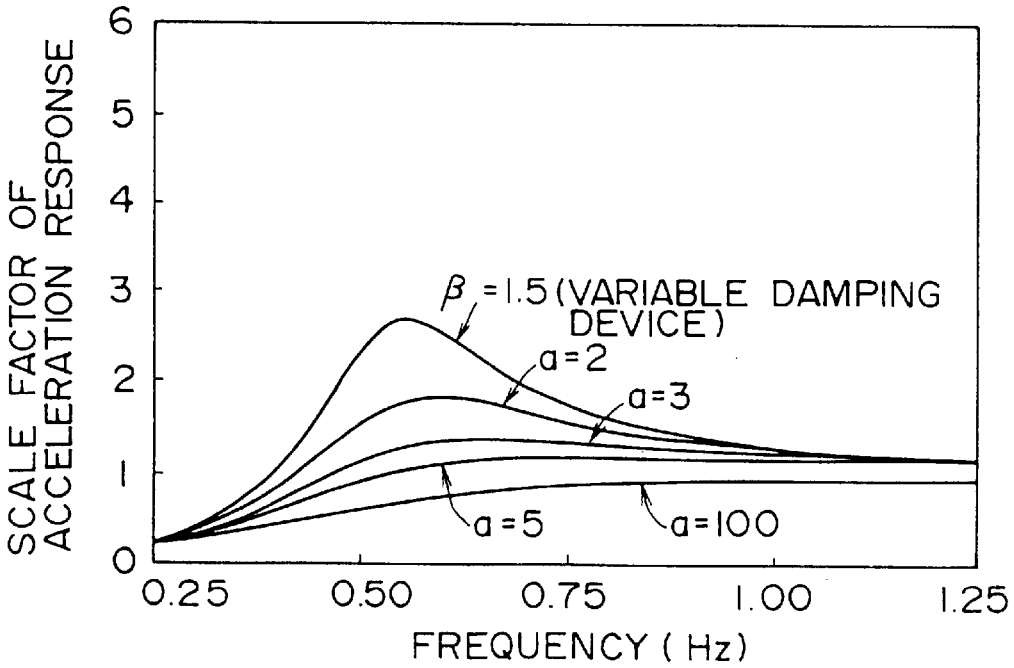
FIG. 22 is a graph showing a scale factor of acceleration response in reference to each case of FIG. 21.
Figure 23:
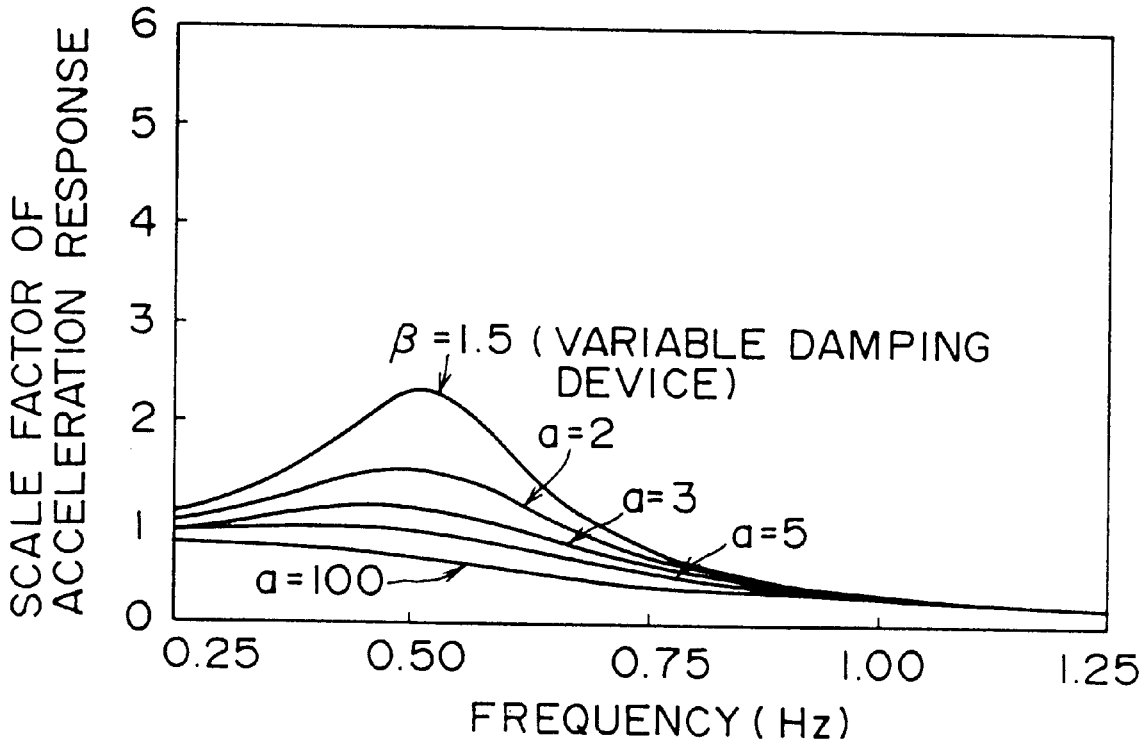
FIG. 23 is a graph showing a scale factor of deformation response in reference to each case in FIG. 21.

FIGS. 22 and 23 are graphs showing a scale factor of acceleration response and a scale factor of deformation response in reference to each case in FIG. 21. It is found that the scale factor of response in each frequency may be substantially reduced as the result of hysteresis control with the actuator.

Figure 24:
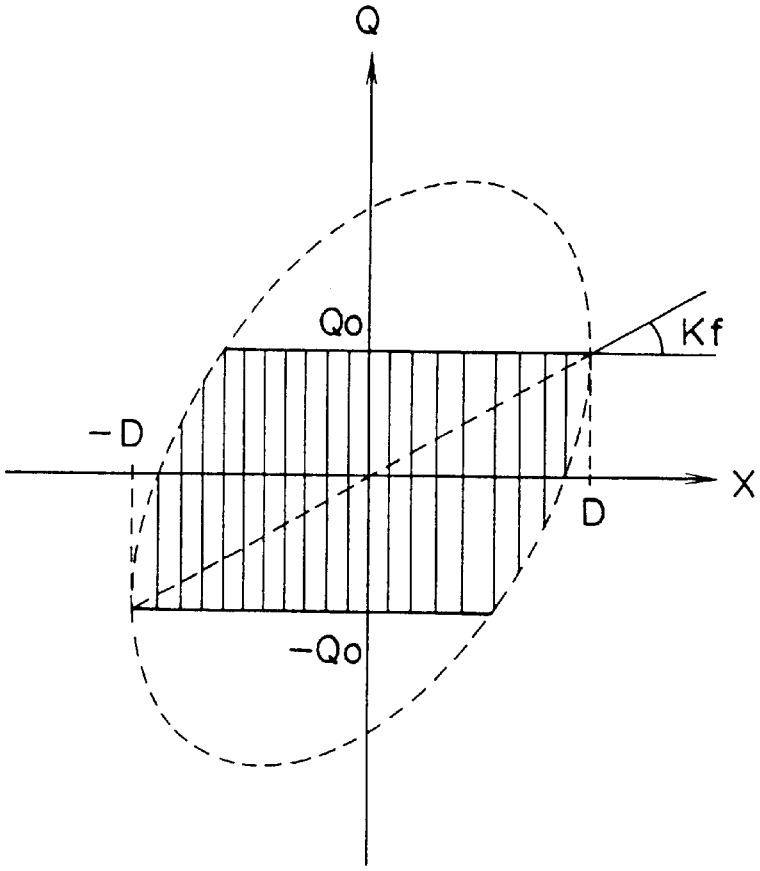
FIG. 24 is a view showing a hysteresis characteristic on a coordinate plane when a confined value proportional to velocity is added to control force generated from an actuator.

FIG. 24 schematically shows a hysteresis characteristic on a coordinate plane when a confined value proportional to a velocity (dx(t)/dt) is added to the control force F generated from the actuator, and it is possible to improve the stability in control without degrading any response reduction effect, in response to the actual seismic vibration having very complicated waveform such as to suddenly change the course of deformation in vibration and so on.

Figure 25:
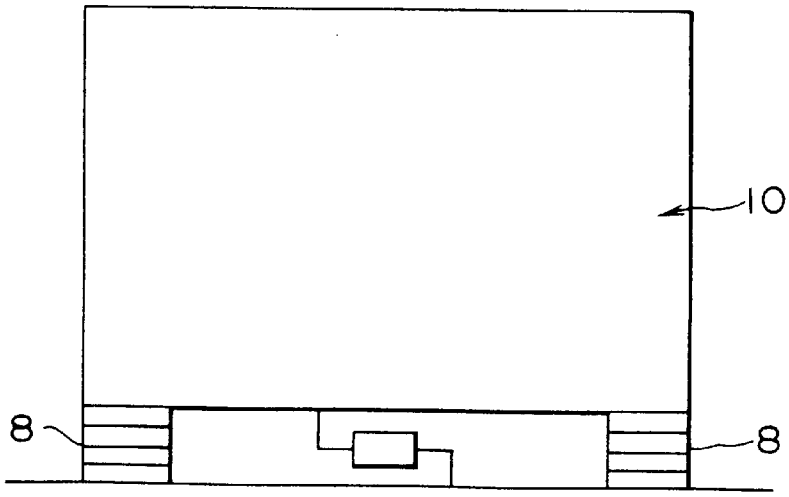
FIG. 25 is an elevation showing a device arrangement in case of control with an actuator installed in a base isolation story.

FIG. 25 shows an outline in case of control with the actuator 31 installed in the base isolation story of the base isolation structure 10.

In this case, the horizontal stiffness of a laminated rubber 8 installed on a foundation to support an upper structure is denoted by $K_f$, restitutive force is denoted by $Q_s$, and the control force F generated from the actuator may be considered to be similar to that when the actuator 31 is installed in the frame composed of columns and beams.

Figure 26A:
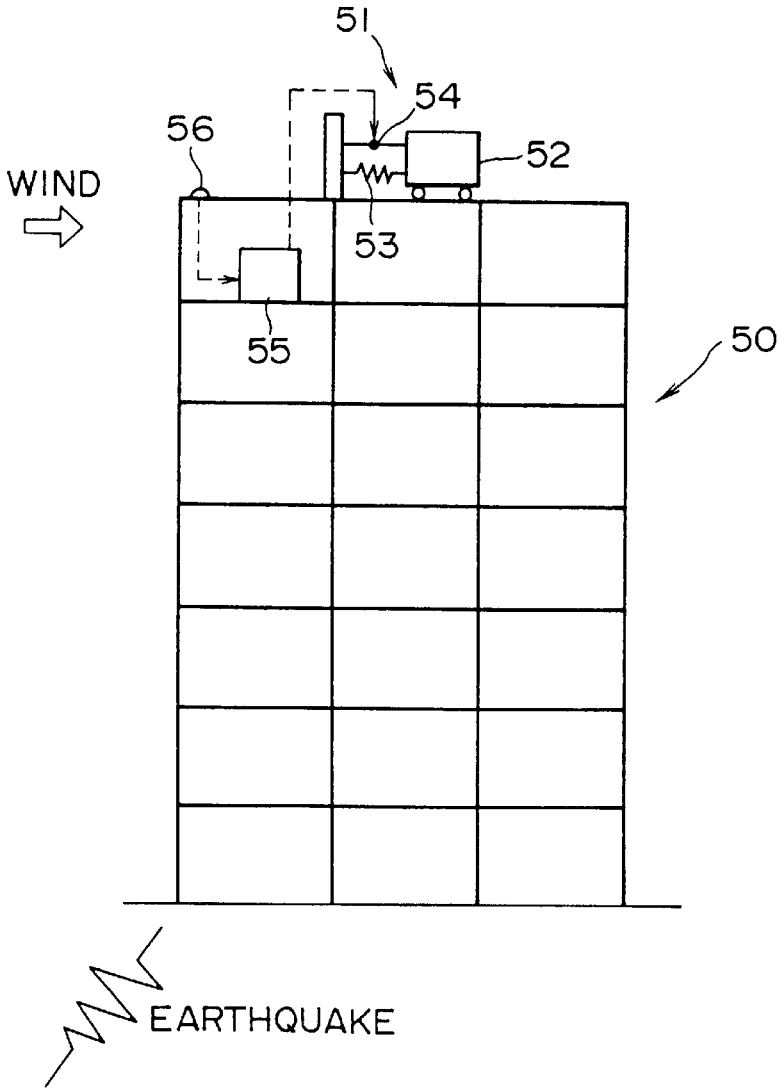
Figure 26B:
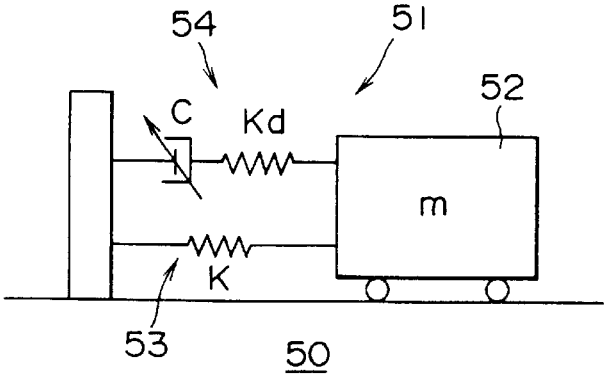

FIGS. 26A and 26B respectively show an embodiment in case of hysteresis control with a variable damping device which is used as a damper incorporated in a dynamic vibration absorber in a seismic response control method for a structure according to the present invention. A non-linear dynamic vibration absorber 51 is installed on the top of a building 50 as shown in FIG. 26A, and controlled with a computer 55 on the basis of information from a sensor 56 for detecting the response of the building 50.

FIG. 26B shows the configuration of a portion of the non-linear dynamic vibration absorber 1 in the form of a dynamic model, and a weight 52 is connected to the building 50 movably in a horizontal direction through a synchronous spring 53 and a variable damping device 54 arranged in parallel to each other. Incidentally, in FIG. 26B, m denotes a mass of the weight 52, K denotes a stiffness of the spring 53, $K_d$ denotes a stiffness of a portion of the variable damping device 54, and c denotes a damping coefficient (variable) of the variable damping device 54.

This configuration is similar to that in the passive dynamic vibration absorber of the prior art in that the response of the building 50 is reduced by synchronizing the weight 52 with the natural period of the building 50 when the building 50 is subjected to vibration due to disturbance such as an earthquake and wind. However, as the result of controlling the variable damping device 54 to provide low damping capacity in the initial stage of the response detected by the sensor 56 in the building 50, the spring 53 mainly exerts its stiffness K, so that a rise of the variable damping device as the dynamic vibration absorber is improved, in comparison with that when the variable damping device 54 is controlled to provide high damping capacity. That is, the weight 52 starts the vibration in the early stage.

Subsequently, in the state that the weight 52 starts the vibration, the variable damping device 54 is controlled to shift its damping capacity to a high state, and as a result, the part of the variable damping device 50 starts exerting its stiffness. Thus, the vibration of the weight 52 may be synchronized with the natural period of the building 50, and the response of the building 50 may be efficiently reduced in the early stage by preliminarily setting the stiffness and the damping capacity of the spring 53 and the part of the variable damping device 54.

Figure 27:
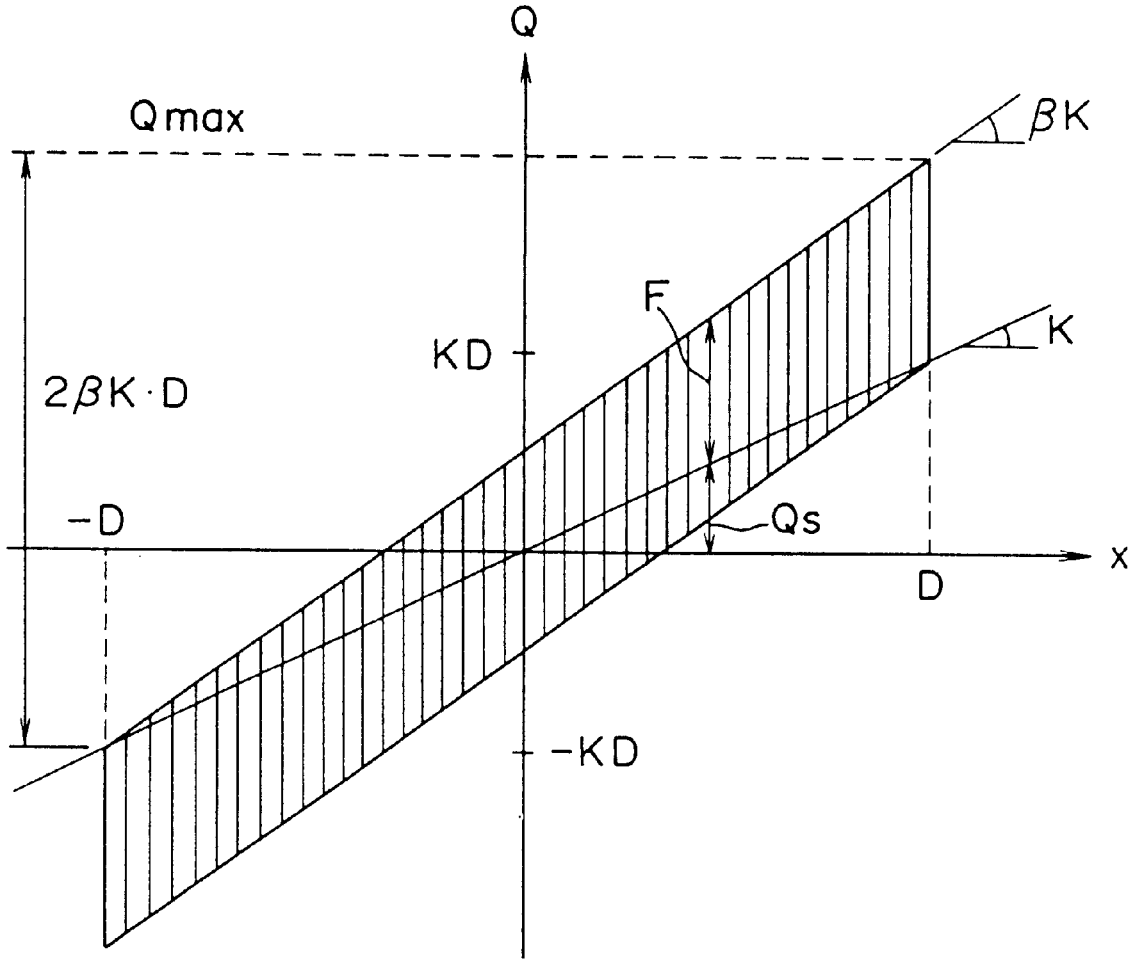
FIG. 27 is a graph showing the relation between a characteristic of restitutive force and structural restrictions in a non-linear dynamic vibration absorber.
Figure 28A:
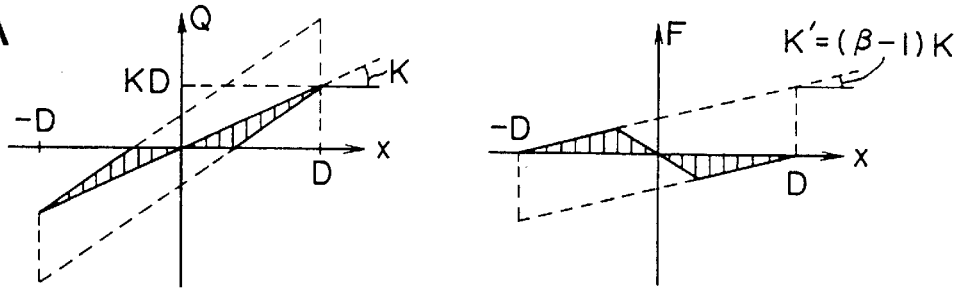
FIG. 28 shows graphs in reference to five kinds of form parameters α of 0 to 2.0, in which graphs on the left side respectively show the relation (characteristic of restitutive force) between restitutive force Q and weight deformation x, and graphs on the right side respectively show the relation between damping force F generated from a variable damping device and weight deformation x.
Figure 28B:
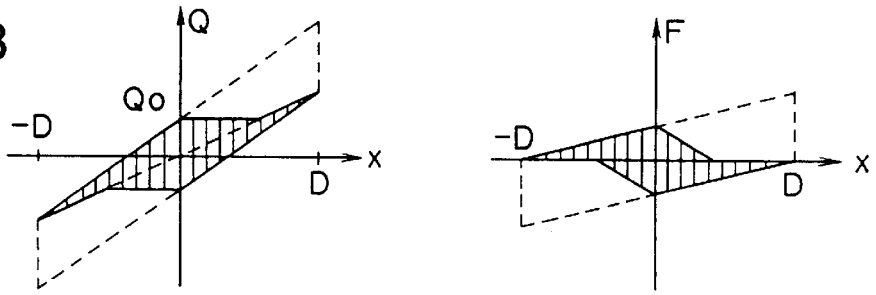
Figure 28C:
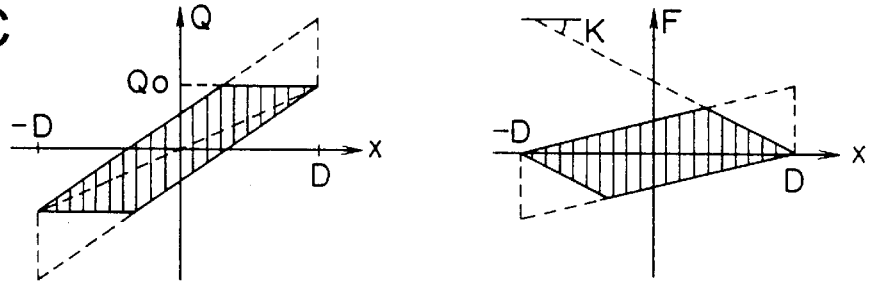
Figure 28D:
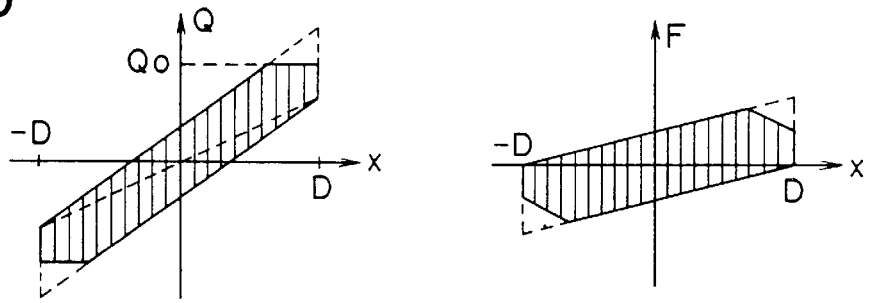
Figure 28E:
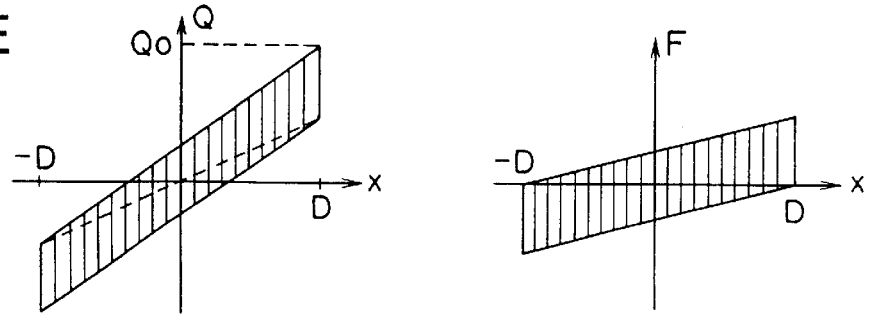

FIG. 27 shows the relation between a characteristic of restitutive force in the non-linear dynamic vibration absorber incorporated with the variable damping device, that is, the sum Q ($=Q_s+F$) of restitutive force $Q_s$ of the spring 53 and the damping force F generated from the variable damping device 54 and the deformation x of the weight 52 in the configuration shown in FIGS. 6A and 26B, and the relation among the characteristic of restitutive force, the deformation x and the structural restrictions.

When the weight is subjected to stationary vibration at an amplitude D, the characteristic of restitutive force in the non-linear dynamic vibration absorber is limited to a parallelogram range shown by hatching in FIG. 27, according to the structural restrictions that the variable damping device (variable dushpot) is used.

In FIG. 27, β denotes a stiffness ratio $[=(K+k_d)/K\geqq 1.0]$ of the stiffness K of only the spring to the total stiffness inclusive of the spring stiffness K and a stiffness $k_d$ of the variable damping device part, and βK denotes a gradient of upper and lower sides of the parallelogram.

According to the present invention, the characteristic of restitutive force is controlled to take the predetermined form under the structural restrictions. In this case, as shown in FIG. 28, for instance, the form of the characteristic of restitutive force shown on the coordinate plane is defined in terms of a form parameter $\alpha[=Q_0/(K\cdot D)](0\leqq\alpha\leqq 2\beta-1$, wherein $Q_0$ denotes a predetermined maximum value of restitutive force (acceleration) for control of the variable damping device on specific condition that D is fixed).

In FIG. 28, graphs on the left side respectively show the relation (characteristic of restitutive force) between the restitutive force Q and the deformation x of a weight, and graphs on the right side respectively show the relation between the damping force F generated from the variable damping device and the deformation x of the weight in reference to five kinds of form parameters a of 0, 0.5, 1, 1.5 and 2.0 when $\beta=1.5$, that is, $k_d/K=0.5$.

In this case, as the result of controlling the variable damping device to provide low damping capacity, $\alpha=0$, for instance, in the initial stage of a response of the building, the weight starts vibration in the early stage.

Subsequently, in the state that the weight starts the vibration, the variable damping device is controlled to shift its damping capacity to a high state by selecting $\alpha=1$, for instance, the response may be reduced in the early stage.

A basic concept in a period of duration of seismic response control after starting the seismic response control is to set a characteristic of restitutive force so as to maximize absorption energy on condition that an amplitude is not more than a certain value D and restitutive force (acceleration) is not more than a certain value $Q_0$ in a certain period of time, and to control this characteristic of restitutive force in response to a kaleidoscopic amplitude D(t).

Figure 29:
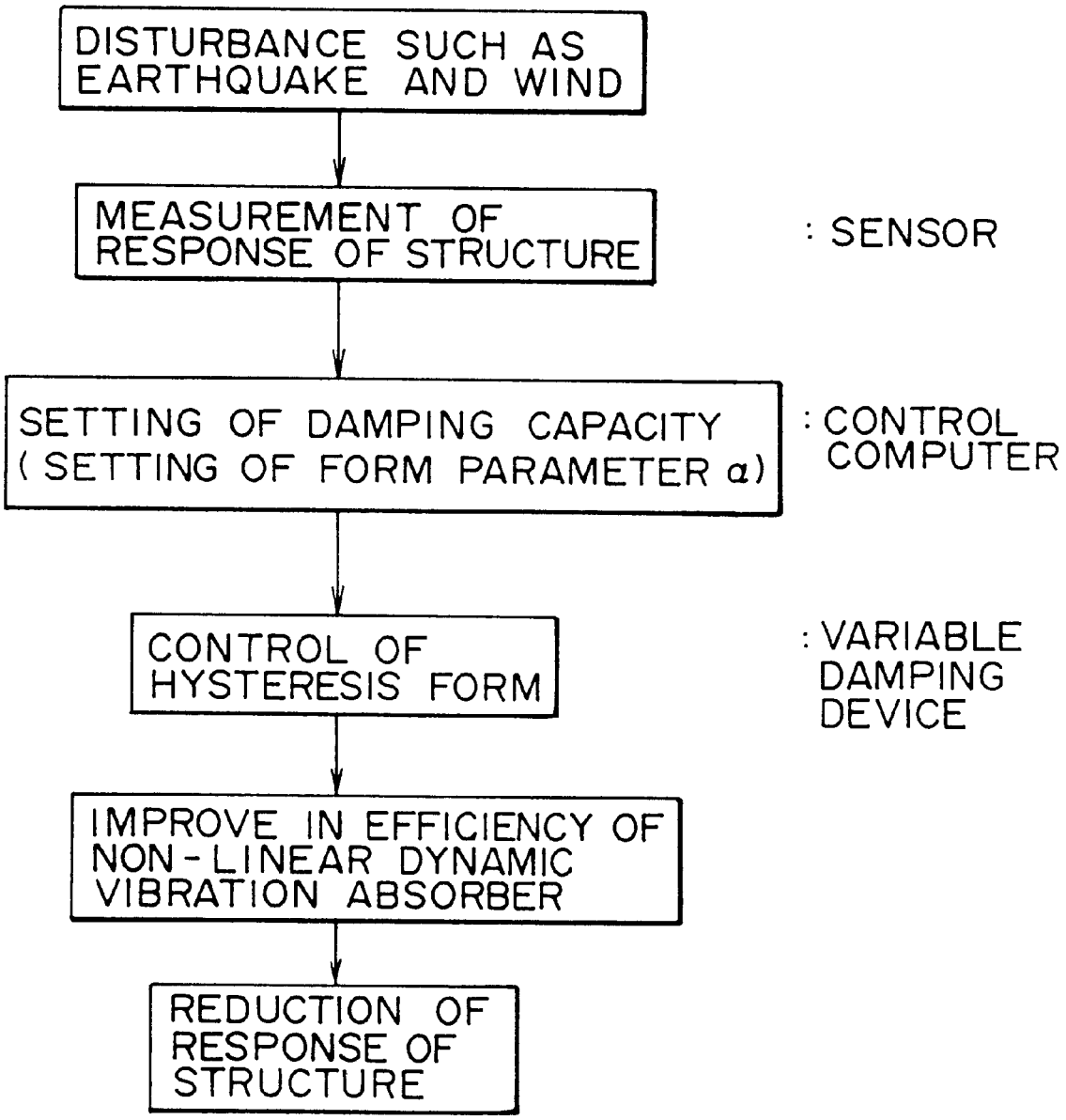
FIG. 29 is a flow chart showing a control procedure.

FIG. 29 shows a control procedure in the form of a flow chart.

First, measure a response of a structure (a building) when subjected to disturbance such as an earthquake and wind, with sensor mounted on the building.

Secondly, set a form parameter $\alpha$ such as to set a form parameter $\alpha$ of 0 (not limited to 0), for instance, to provide low damping capacity in the initial stage of vibration, or in the state of small vibration.

Set a form parameter $\alpha$ of 1 (not limited to 1), for instance, to provide high damping capacity when vibrations is increased.

As the result of controlling the form (hysteresis form) of the characteristic of restitutive force, which is shown on a coordinate plane, in the dynamic vibration absorber, with the variable damping device to maintain the form parameter $\alpha$ selected as described above, it is possible to improve the efficiency of the dynamic vibration absorber in a simplified mode, so that the response of the structure is efficiently reduced.

Figure 30A:
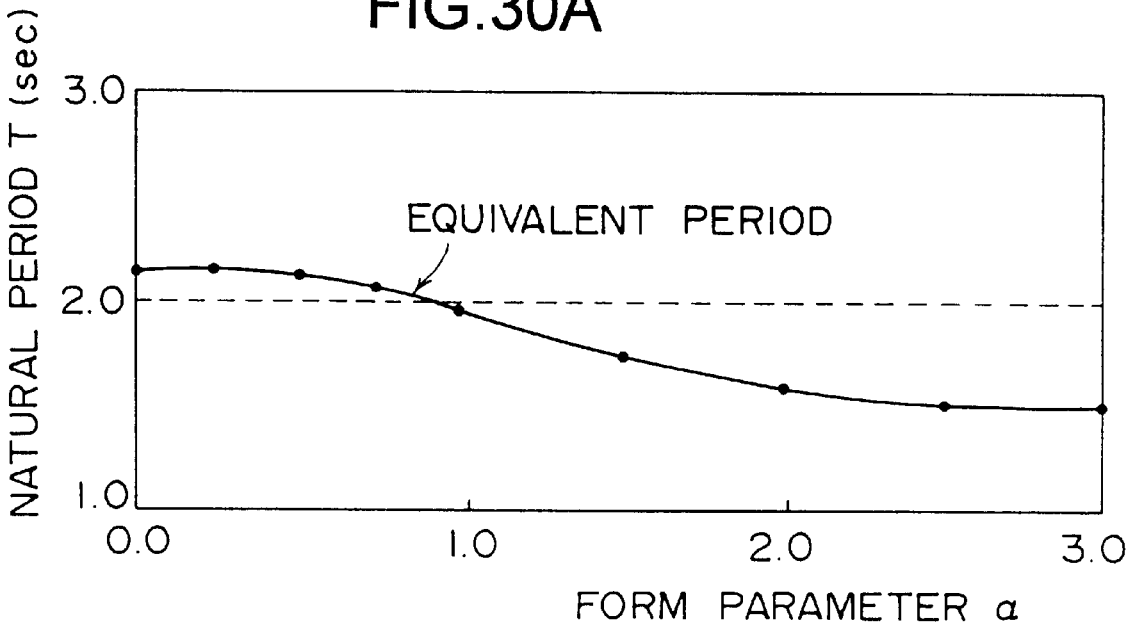
FIG. 30 is a graph showing the relation between a form parameter α and a variation of a natural period T of a dynamic vibration absorber and that of a damping factor h.
Figure 30B:
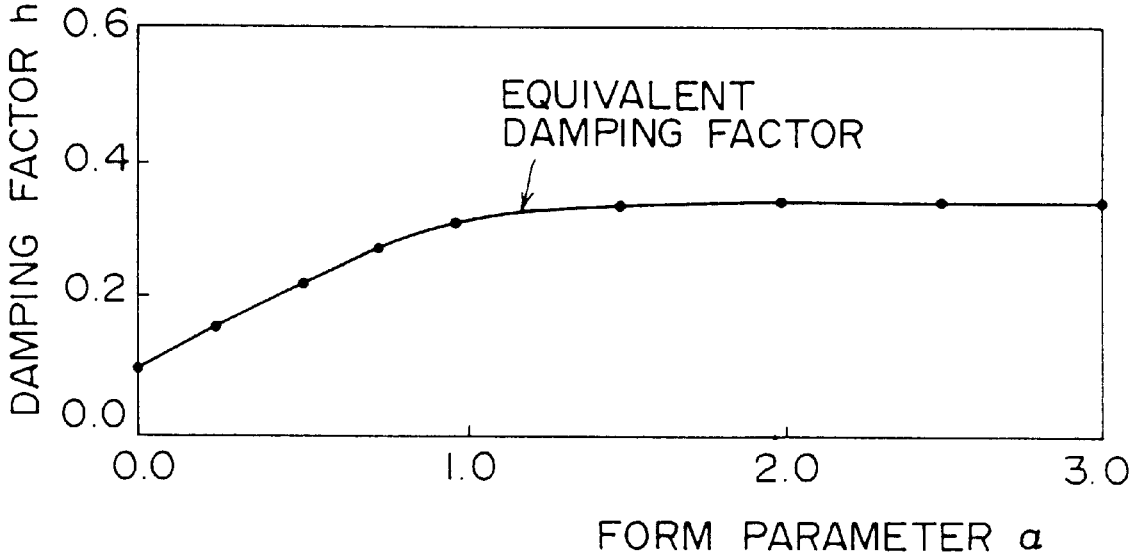

On the other hand, in the non-linear dynamic vibration absorber, as the result of controlling (varying) the hysteresis form, it is possible to adjust the period T (synchronization period) and the damping factor of the dynamic vibration absorber. FIG. 30 shows a variation of the period T (equivalent period) and the damping factor h (equivalent damping factor) of the dynamic vibration absorber when the form parameter $\alpha$ is varied under specific conditions.

As shown in FIG. 30, the form parameter $\alpha$ corresponds uniquely to the period of the dynamic vibration absorber. Accordingly, as the result of presetting the spring to exert its small stiffness K, and also presetting a form parameter $\alpha$ to a value which provides a synchronization period to the weight of the dynamic vibration damper when the form parameter $\alpha$ is adapted to shift a value of a form parameter $\alpha$ for producing the inherent response reduction effects to a high state after the dynamic vibration absorber rises when the form parameter $\alpha$ is placed in the low state, it is possible to perform considerably efficient seismic response control by varying both the period and the damping factor of the dynamic vibration absorber.

What is claimed is:

1. A seismic response control method for a structure, comprising the steps of:

installing a seismic response control device in a structural component of stiffness $K_f$ at each story of said structure; and controlling a characteristic of story restitutive force Q given as a sum of restitutive force $Q_s$ of said structural component installed with the seismic response control device and force F generated by said seismic response control device so as to maintain or vary a form of a characteristic of the story restitutive force shown on a coordinate plane as a relationship between an amplitude D(t) of a portion of said structural component and story restitutive force Q(t), in response to changing states of vibration;

wherein said controlling step is performed in a story by story basis independently from the other story of said structure by regulating said seismic response control device through a negative feedback loop.

2. A seismic response control method for a structure according to claim 1, wherein said method further comprises the steps of:

setting a characteristic of story restitutive force of a target story of said structure in response to an earthquake and a characteristic of story restitutive force of a target story of said structure in response to wind independently of each other;

providing a judgment means to select between the characteristic of story restitutive force in response to the earthquake and the characteristic of story restitutive force in response to the wind on the basis of a detected seismic load and a detected wind load; and performing control of said seismic response control device on the basis of the characteristic of story restitutive force selected by said judgment means.

3. A seismic response control method for a structure, comprising the steps of:

installing an earthquake-resisting component in a frame of stiffness of $K_f$ composed of columns and beams through a variable damping device at each story of said structure;

in reference to a characteristic of story restitutive force Q given as a sum of restitutive force $Q_s$ of only the frame composed of columns and beams in a story installed with the variable damping device and damping force F generated by the variable damping device, selecting a specified characteristic of story restitutive force which represents a relationship between a story amplitude D(t) and story restitutive force Q(t) to optimize energy absorption property or response reduction effects in a range controllable by said variable damping device, in response to changes in a state of vibration on the basis of frequency transfer characteristics of a target story in response to an earthquake or wind; and controlling the damping force F generated by said variable damping device so as to maintain said characteristic of story restitutive force, which is shown on a coordinate plane, in a quasi-similar figure, in response to the changes of the state of vibration;

wherein said controlling step is performed in a story by story basis independently from the other story of said structure by regulating said variable damping device through a negative feedback loop.

4. A seismic response control method for a structure according to claim 3, wherein said method further comprises the steps of:

finding a deformation $X_B$ of the earthquake-resisting component on the basis of the damping force F generated and measured by said variable damping device;

finding a story deformation x and a story velocity dx/dt of a target story on the basis of both the deformation $X_B$ of the earthquake-resisting component portion and a deformation $X_D$ of the variable damping device measured by a sensor; and finding a control command value u(t) corresponding to a characteristic of story restitutive force on the basis of both the story deformation x and the story velocity dx/dt.

5. A seismic response control method for a structure according to claim 4, wherein it further comprises the steps of:

finding an envelope waveform D(t) of a varying story deformation x(t); and finding a control command value u(t) with a control circuit which provides $$u(t)=-K_f\{x(t)-\alpha\cdot sgn(dx(t)/dt)\}D(t)$$

(wherein $\alpha$ is a form parameter defined by $\alpha=Q/K_f\cdot D$, and wherein sgn is +1 when $(dx(t)/dt)\geqq 0$, while being −1 when $(dx(t)/dt)<0$).

6. A seismic response control method for a structure, comprising the steps of:

installing an earthquake-resisting component in a frame of stiffness $K_f$ composed of columns and beams through a variable damping device at each story of said structure;

in reference to a characteristic of story restitutive force Q given as a sum of restitutive force $Q_s$ of only the frame composed of columns and beams in a story installed with the variable damping device and damping force F generated by said variable damping device, finding a form parameter $\alpha=Q_0/(K_f \cdot D)$, which is concerned with a characteristic of story restitutive force representing a relationship between a story amplitude D and story restitutive force Q in a certain vibration state and provides, on a coordinate plane, a characteristic of story restitutive force to maximize energy absorption property in reference to a plurality of arbitrary story restitutive forces $Q_0$ controllable by said variable damping device, in response to changes in a state of vibration on the basis of frequency transfer characteristics of a target story in response to an earthquake or wind;

selecting a specific form parameter $\alpha$ such as to optimize energy absorption property or response reduction effects among a plurality of form parameters $\alpha$ thus found; and controlling the damping force F generated by said variable damping device so as to maintain said form parameter $\alpha$ substantially constant in response to the change of the state of vibration;

wherein said controlling step is performed in a story by story basis independently from the other story of said structure by regulating said variable damping device through a negative feedback loop.

7. A seismic response control method for a structure according to claim 6, wherein said method further comprises the steps of:

finding a deformation $x_B$ of an earthquake-resisting component on the basis of the damping force F generated and measured by said variable damping device;

finding a story deformation x and a story velocity dx/dt of a target story on the basis of both the deformation $X_B$ of the earthquake-resisting component and a deformation $X_D$ of said variable damping device measured by a sensor; and finding a control command value u(t) corresponding to a characteristic of story restitutive force on the basis of both the story deformation x and the story velocity dx/dt.

8. A seismic response control method for a structure according to claim 7, wherein said method further comprises the steps of:

finding an envelope waveform D(t) of a varying story deformation x(t); and finding a control command value u(t) with a control circuit which provides $$u(t)=-K_f\{x(t)-\alpha\cdot sgn(dx(t)/dt)\}D(t)$$

(wherein sgn is +1 when $(dx(t)/dt)\geqq 0$, while being −1 when $(dx(t)/dt)<0$).

9. A seismic response control method for a structure, comprising the steps of:

installing an earthquake-resisting component in a frame of stiffness $k_f$ composed of columns and beams through a variable damping device at each story of said structure;

in reference to a characteristic of story restitutive force Q given as a sum of restitutive force $Q_s$ of only the frame composed of columns and beams in a story installed with the variable damping device and damping force F generated by said variable damping device, finding a form parameter $\alpha=Q_0/(K_f \cdot D)$, which is concerned with a characteristic of story restitutive force representing a relationship between a story amplitude D and story restitutive force Q in a certain vibration state and provides, on a coordinate plane, a characteristic of story restitutive force to maximize energy absorption property in reference to a plurality of arbitrary story restitutive forces $Q_0$ controllable by said variable damping device, in response to changes in a state of vibration on the basis of frequency transfer characteristics of a target story in response to an earthquake or wind;

finding a natural period T of the structure when each of a plurality of form parameters $\alpha$ thus found is respectively selected; and controlling the damping force F generated by said variable damping device so as to provide a form parameter $\alpha$ which enables unresonance as much as possible, in response to the change of the state of vibration;

wherein said controlling step is performed in a story by story basis independently from the other story of said structure by regulating said variable damping device through a negative feedback loop.

10. A seismic response control method for a structure according to claim 9, wherein said method further comprises the steps of:

setting a characteristic of story restitutive force of a target story of said structure in response to an earthquake and a characteristic of story restitutive force of the target story in response to wind independently of each other;

providing a judgment means to select between the characteristic of story restitutive force in response to the earthquake and the characteristic of story restitutive force in response to the wind on the basis of a detected seismic load and a detected wind load; and performing control of the variable damping device on the basis of the characteristic of story restitutive force selected by said judgment means.

11. A seismic response control method for a structure, comprising the steps of:

installing a variable damping device in a base isolation story of horizontal stiffness $K_f$, which supports an upper structure on a foundation through a horizontal spring component, in parallel to said horizontal spring component;

in reference to a characteristic of story restitutive force Q given as a sum of restitutive force $Q_s$ of only said horizontal spring component in the base isolation story installed with the variable damping device and damping force F generated by said variable damping device, selecting a specified characteristic of story restitutive force which represents a relationship between a story amplitude D(t) and story restitutive force Q(t) to maximize energy absorption property or response reduction effects within a range controllable by said variable damping device, in response to changes in a state of vibration on the basis of frequency transfer characteristics of the base isolation story in response to an earthquake or wind; and controlling the damping force F generated by said variable damping device so as to maintain said characteristic of story restitutive force, which is shown on a coordinate plane, in a quasi-similar figure, in response to the change of the state of vibration;

wherein said controlling step is performed on the variable damping device in said base isolation story independently from the upper structure by regulating the variable damping device through a feedback loop.

12. A seismic response control method for a structure according to claim 11, wherein said method further comprises the steps of:

setting a characteristic of story restitutive force of a target story of the structure in response to an earthquake and a characteristic of story restitutive force of the target story in response to wind independently of each other;

providing a judgment means to select between the characteristic of story restitutive force in response to the earthquake and the characteristic of story restitutive force in response to the wind on the basis of a detected seismic load and a detected wind load; and performing control over the variable damping device on the basis of the characteristic of story restitutive force selected by said judgment means.

13. A seismic response control method for a structure, comprising the steps of:

installing a variable damping device in a base isolation story of horizontal stiffness $K_f$, which supports an upper structure on a foundation through a horizontal spring component, in parallel to said horizontal spring component;

in reference to a characteristic of story restitutive force Q given as the sum of restitutive force $Q_s$ of only said horizontal spring component in the base isolation story installed with said variable damping device and damping force F generated by said variable damping device, finding a specific form parameter $\alpha=Q_0/(K_f \cdot D)$, which is concerned with a characteristic of story restitutive force representing a relationship between a story amplitude D and story restitutive force Q in a certain vibration state and provides, on a coordinate plane, a characteristic of story restitutive force to maximize energy absorption property in reference to a plurality of arbitrary story restitutive forces $Q_0$ controllable by said variable damping device, in response to changes in a state of vibration on the basis of frequency transfer characteristics of the base isolation story in response to an earthquake or wind;

selecting a specific form parameter $\alpha$ such as to optimize energy absorption property or response reduction effects among a plurality of form parameters $\alpha$ thus found; and controlling the damping force F generated by said variable damping device so as to maintain said form parameter $\alpha$ substantially constant, in response to the change of the state of vibration;

wherein said controlling step is performed on the variable damping device in said base isolation story independently from the upper structure by regulating the variable damping device through a feedback loop.

14. A seismic response control method for a structure according to claim 13, wherein said method further comprises the steps of:

setting a characteristic of story restitutive force of a target story of the structure in response to an earthquake and a characteristic of story restitutive force of the target story in response to wind independently of each other;

providing a judgment means to select between the characteristic of story restitutive force in response to the earthquake and the characteristic of story restitutive force in response to the wind on the basis of a detected seismic load and a detected wind load; and performing control over the variable damping device on the basis of the characteristic of story restitutive force selected by said judgment means.

15. A seismic response control method for a structure, comprising the steps of:

installing a variable damping device in a base isolation story of stiffness $K_f$, which supports an upper structure on a foundation through a horizontal spring component, in parallel to said horizontal spring component;

in reference to a characteristic of story restitutive force Q given as the a of restitutive force $Q_s$ of only said horizontal spring component in the base isolation story installed with the variable damping device and damping force F generated by said variable damping device, finding a form parameter $\alpha=Q_0/K_f \cdot D)$, which is concerned with a characteristic of story restitutive force representing a relationship between a story amplitude D and story restitutive force Q in a certain vibration state and provides, on a coordinate plane, a characteristic of story restitutive force to maximize energy absorption property in reference to a plurality of arbitrary story restitutive forces $Q_0$ controllable by said variable damping device, in response to changes in a state of vibration on the basis of frequency transfer characteristics of the base isolation story in response to an earthquake or wind;

further finding a natural period T of the structure when each of a plurality of form parameters $\alpha$ thus found is respectively selected; and controlling the damping force F generated by said variable damping device so as to provide a form parameter $\alpha$ which enables unresonance as much as possible in response to the change of the state of vibrations;

wherein said controlling step is performed on the variable damping device in said base isolation story independently from the upper structure by regulating the variable damping device through a feedback loop.

16. A seismic response control method for a structure according to claim 15, wherein said method further comprises the steps of:

setting a characteristic of story restitutive force of a target story of the structure in response to an earthquake and a characteristic of story restitutive force of the target story in response to wind independently of each other;

providing a judgment means to select between the characteristic of story restitutive force in response to the earthquake and the characteristic of story restitutive force in response to the wind on the basis of a detected seismic load and a detected wind load; and performing control over the variable damping device on the basis of the characteristic of story restitutive force selected by said judgment means.

17. A seismic response control method for a structure, comprising the steps of:

installing an earthquake-resisting component in a frame of stiffness $K_f$ composed of columns and beams through an actuator functioning as a seismic response control device at each story of said structure; and controlling a characteristic of story restitutive force Q given as a sum of restitutive force $Q_s$ of only the frame composed of columns and beams in a story installed with the actuator and control force F generated by the actuator as restitutive force acting between the frame composed of columns and beams and the earthquake-resisting component, so as to maintain the characteristic of story restitutive force, which is shown on a coordinate plane as a relationship between a story amplitude D and story restitutive force Q, in a quasi-similar figure, in response to changes in a state of vibration;

wherein said controlling step is performed in a story by story basis independently from the other story of said structure by regulating said actuator through a negative feedback loop.

18. A seismic response control method for a structure according to claim 17, wherein said method further comprises the step of maintaining said characteristic of story restitutive force, which is shown on a coordinate plane, in the form of a quasi-rectangle symmetrical about the axes of abscissa and ordinate.

19. A seismic response control method for a structure according to claim 17, wherein said method further comprises the step of maintaining said characteristic of story restitutive force, which is shown on a coordinate plane, in the form resulting from adding a confined value proportional to velocity to a quasi-rectangle symmetrical about the axes of abscissa and ordinate.

20. A seismic response control method for a structure, comprising the steps of:

installing an actuator functioning as a seismic response control device in a base isolation story of horizontal stiffness $K_f$, which supports an upper structure on a foundation through a horizontal spring component, in parallel to said horizontal spring component; and controlling a characteristic of story restitutive force Q given as a sum of restitutive force $Q_s$ of only said horizontal spring component in the base isolation story installed with the actuator and control force F generated by the actuator so as to maintain the characteristic of story restitutive force, which is shown on a coordinate plane as a relationship between a story amplitude D and story restitutive force Q, in a quasi-similar figure, in response to changes in a state of vibration;

wherein said controlling step is performed on the variable damping device in said base isolation story independently from the upper structure by regulating the actuator through a feedback loop.

21. A seismic response control method for a structure according to claim 20, wherein said method further comprises the step of maintaining said characteristic of story restitutive force, which is shown on a coordinate plane, in the form of a quasi-rectangle symmetrical about the axes of abscissa and ordinate.

22. A seismic response control method for a structure according to claim 20, wherein said method further comprises the step of maintaining said characteristic of story restitutive force, which is shown on a coordinate plane, in the form resulting from adding a confined value proportional to velocity to a quasi-rectangle symmetrical about the axes of abscissa and ordinate.

23. A seismic response control method for a structure, comprising the steps of:

connecting a structure and a weight horizontally movable in parallel to said structure together through a spring of stiffness K for synchronizing vibration of the weight with vibration of the structure, while providing a variable damping device in parallel to said spring;

in reference to a characteristic of story restitutive force Q, in response to the vibration of said weight, given as a sum of restitutive force $Q_s$ of only the spring and damping force F generated by the variable damping device, finding a characteristic of restitutive force to maximize energy absorption property in reference to a plurality of arbitrary restitutive forces $Q_0$ controllable by said variable damping device, as a characteristic of restitutive force which represents a relationship between a weight amplitude D and restitutive force Q in changes in a state of vibration; and controlling a form parameter $\alpha=Q_0/(K\cdot D)$ which attains said characteristic of restitutive force on a coordinate plane so as to represent a characteristic of restitutive force corresponding to a value $\alpha_1$ which provides low damping capacity in the initial stage of a response of said structure to disturbance, and to subsequently represent a characteristic of restitutive force corresponding to a value $\alpha_2$ which provides high damping capacity with an increase of the response of the structure;

wherein said controlling step is performed in a story by story basis independently from the other story of said structure by regulating said variable dam ping device through a negative feedback loop.

24. A seismic response control method for a structure according to claim 23, wherein said method further comprises the steps of:

preliminarily setting the stiffness K of said spring to be lower than stiffness $K_0$ which allows the vibration of the weight to synchronize with the vibration of the structure in case of installing no variable damping device, while setting a vibration period of the weight to be longer than the natural period of the structure; and shifting said form parameter $\alpha$ from a value $\alpha_1$, which provides the low damping capacity to a value $\alpha_2$ which provides the high damping capacity so as to set the weight vibration period determined on the basis of said spring and said parameter $\alpha$ to be close to a natural period of the structure.

* * * * *